US011181845B2

(12) United States Patent
Shimoda et al.

(10) Patent No.: US 11,181,845 B2
(45) Date of Patent: Nov. 23, 2021

(54) TONER

(71) Applicant: CANON KABUSHIKI KAISHA, Tokyo (JP)

(72) Inventors: Taku Shimoda, Machida (JP); Masashi Kawamura, Yokohama (JP); Takayuki Toyoda, Suntou-gun (JP); Kenji Ookubo, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/853,894

(22) Filed: Apr. 21, 2020

(65) Prior Publication Data

US 2020/0341400 A1 Oct. 29, 2020

(30) Foreign Application Priority Data

Apr. 25, 2019 (JP) ..... JP2019-083936

(51) Int. Cl.
*G03G 9/08* (2006.01)
*G03G 9/097* (2006.01)
*G03G 9/087* (2006.01)

(52) U.S. Cl.
CPC ..... *G03G 9/09733* (2013.01); *G03G 9/08711* (2013.01); *G03G 9/08755* (2013.01); *G03G 9/08773* (2013.01)

(58) Field of Classification Search
CPC ..... G03G 9/08773; G03G 9/09733; G03G 9/08711; G03G 9/08755
USPC ..... 430/108.3
See application file for complete search history.

(56) References Cited

U.S. PATENT DOCUMENTS

| | | | |
|---|---|---|---|
| 7,141,342 | B2 | 11/2006 | Toyoda et al. |
| 7,264,910 | B2 | 9/2007 | Toyoda et al. |
| 7,288,357 | B2 | 10/2007 | Toyoda et al. |
| 7,833,685 | B2 | 11/2010 | Tanaka et al. |
| 7,833,687 | B2 | 11/2010 | Kato et al. |
| 8,211,606 | B2 | 7/2012 | Murai et al. |
| 8,377,616 | B2 | 2/2013 | Tani et al. |
| 8,628,899 | B2 | 1/2014 | Kawamura et al. |
| 8,697,327 | B2 | 4/2014 | Shibata et al. |
| 8,815,484 | B2 | 8/2014 | Tanaka et al. |
| 8,916,319 | B2 | 12/2014 | Ikeda et al. |
| 8,940,467 | B2 | 1/2015 | Hashimoto et al. |
| 9,146,485 | B2 | 9/2015 | Tani et al. |
| 9,170,509 | B2 | 10/2015 | Masuda |
| 9,556,290 | B2 | 1/2017 | Nishiura et al. |
| 9,715,187 | B2 | 7/2017 | Mukumoto et al. |
| 9,829,814 | B2 | 11/2017 | Yoshida et al. |
| 9,857,711 | B2 | 1/2018 | Yoshida et al. |
| 9,880,478 | B2 | 1/2018 | Shimano et al. |
| 9,921,501 | B2 | 3/2018 | Mochizuki et al. |
| 10,054,866 | B2 | 8/2018 | Tanaka et al. |
| 10,416,582 | B2 | 9/2019 | Nakagawa et al. |
| 10,437,165 | B2 | 10/2019 | Shimano et al. |
| 10,545,420 | B2 | 1/2020 | Kinumatsu et al. |
| 2008/0299482 | A1 | 12/2008 | Kato et al. |
| 2010/0035171 | A1 | 2/2010 | Watanabe et al. |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2016/0327882 | A1* | 11/2016 | Isono ..... G03G 9/0806 |
| 2020/0041922 | A1 | 2/2020 | Shimano et al. |

FOREIGN PATENT DOCUMENTS

| | | |
|---|---|---|
| JP | H07-239573 | 9/1995 |
| JP | 6020458 | 11/2016 |

OTHER PUBLICATIONS

Nishikubo, "Addition Reaction of Epoxy Compounds with Esters and Its Application for Polymer Syntheses", Journal of Synthetic Organic Chemistry, vol. 49, No. 3 (1991) 218-33 (English translation of "an insertion reaction of an epoxy compound into an ester bond in a polymer chain", p. 227, left column, line 8 to p. 229, left column, line 18).

(Continued)

*Primary Examiner* — Mark A Chapman
(74) *Attorney, Agent, or Firm* — Venable LLP

(57) ABSTRACT

A toner comprising a toner particle that contains a binder resin, a resin represented by formula (1), and wax, wherein the wax contains an ester compound that exhibits a compatibility at 100° C. of at least 5.0 mass parts per 100.0 mass parts of the binder resin: wherein in formula (1), $P^1$ represents a macromolecular segment; $L^1$ represents a single bond or a divalent linking group; $R^1$ to $R^3$ each independently represent a hydrogen atom, halogen atom, alkyl group, alkoxy group, hydroxy group, or aryl group; m represents a positive integer; and when m is equal to or greater than 2, a plurality of $L^1$'s, a plurality of $R^1$'s, a plurality of $R^2$'s, and a plurality of $R^3$'s may be the same as or different from each other.

(1)

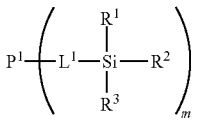

14 Claims, No Drawings

(56) References Cited

OTHER PUBLICATIONS

Harazaki, "Basic Coating Science" Table 3-9, Maki Shoten Publishing (1977) 54-57 (Partial English Translation).
U.S. Appl. No. 16/847,982, Kenji Ookubo, filed Apr. 14, 2020.
U.S. Appl. No. 16/853,891, Masashi Kawamura, filed Apr. 21, 2020.

* cited by examiner

TONER

BACKGROUND OF THE INVENTION

Field of the Invention

The present invention relates to a toner used to form a toner image by the development of an electrostatic latent image formed by a method such as electrophotography, electrostatic recording, toner jet recording methods, and so forth.

Description of the Related Art

Energy savings have come to be regarded in recent years as a major technical issue for copiers, printers, and facsimile machines, and substantial reductions in the amount of heat required by the image fixing apparatus are therefore desired. Thus, with regard to the toner, there is great need for image fixing to be made possible at lower energies, i.e., for low-temperature fixability.

General methods for improving the low-temperature fixability of toner include, for example, lowering the glass transition temperature (Tg) of the binder resin and reducing the molecular weight of the binder resin, in each instance with the goal of softening the binder resin being used. However, the following, for example, occur when just a lowering of the Tg of the binder resin or a reduction in its molecular weight is brought about by itself: the generation of offset at the fixing member due to an inadequate releasability during fixing; a reduction in the heat resistance during toner storage; and so forth.

The addition of a plasticizer is therefore used as a method for improving the fixing performance of toner without lowering the Tg of the binder resin. In order to bring about sufficient softening of the toner during fixing, a plasticizer must be used that is highly compatible with the binder resin and that exhibits a large plasticizing capacity.

Japanese Patent No. 6020458 proposes a toner that uses an ester wax as a plasticizer for the binder resin.

In addition, methods for improving the releasability during the fixing of toners that use a low molecular weight binder resin include methods in which a silicone oil is mixed into the binder resin and methods that use a binder resin that contains a siloxane compound.

Japanese Patent Application Laid-open No. H07-239573 proposes a toner that contains, as binder resin, a vinyl resin provided by the copolymerization of vinyl monomer and a silane coupling agent that has an unsaturated double bond and an alkoxysilyl group.

SUMMARY OF THE INVENTION

Through the use of a specific diester compound that has an excellent plasticizing performance, the toner described in Japanese Patent No. 6020458 exhibits the effects of a reduction in toner viscosity during fixing and an improved low-temperature fixability.

However, the following problem has been found for the fixed image obtained using this toner: the diester compound becomes externalized over time at the surface of the fixed image and the gloss presented by the fixed image declines.

With the toner described in Japanese Patent Application Laid-open No. H07-239573, an excellent resistance to fixing offset and an excellent transferability from the photosensitive member are obtained due to the release effect that is characteristic of silicone resins as a consequence of the siloxane bond produced when the alkoxysilyl group-bearing silane coupling agent undergoes crosslinking.

However, the toner described in Japanese Patent Application Laid-open No. H07-239573 does not have a satisfactory low-temperature fixability.

Moreover, it was found that, even when the diester compound described in Japanese Patent No. 6020458 is incorporated as such in the toner described in Japanese Patent Application Laid-open No. H07-239573, the diester compound becomes externalized over time at the surface of the resulting fixed image and the gloss declines.

The present invention therefore provides a toner that has an excellent low-temperature fixability and that provides a fixed image that causes a smaller decline in gloss over time.

The present invention relates to a toner comprising a toner particle that contains a binder resin, a resin represented by formula (1), and wax, wherein the wax contains an ester compound that exhibits a compatibility at 100° C. of at least 5.0 mass parts per 100.0 mass parts of the binder resin:

(1)

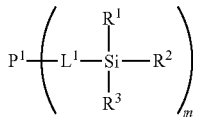

wherein in formula (1), $P^1$ represents a macromolecular segment; $L^1$ represents a single bond or a divalent linking group; $R^1$ to $R^3$ each independently represent a hydrogen atom, halogen atom, alkyl group, alkoxy group, hydroxy group, or aryl group; m represents a positive integer; and when m is equal to or greater than 2, a plurality of $L^1$'s may be the same as or different from each other, a plurality of $R^1$'s may be the same as or different from each other, a plurality of $R^2$'s may be the same as or different from each other, and a plurality of $R^3$'s may be the same as or different from each other.

Also, the present invention relates to a toner comprising a toner particle that contains a binder resin, a resin represented by formula (1), and wax, wherein the wax contains an ester compound, and the ester compound is a condensate of a diol having from 2 to 10 carbons and an aliphatic monocarboxylic acid having from 14 to 22 carbons and has a melting point of from 60° C. to 100° C.:

(1)

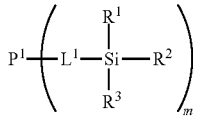

wherein in formula (1), $P^1$ represents a macromolecular segment; $L^1$ represents a single bond or a divalent linking group; $R^1$ to $R^3$ each independently represent a hydrogen atom, halogen atom, alkyl group, alkoxy group, hydroxy group, or aryl group; m represents a positive integer; and when m is equal to or greater than 2, a plurality of $L^1$'s may be the same as or different from each other, a plurality of $R^1$'s may be the same as or different from each other, a plurality of $R^2$'s may be the same as or different from each other, and a plurality of $R^3$'s may be the same as or different from each other.

The present invention can thus provide a toner that has an excellent low-temperature fixability, that provides a fixed image which causes a smaller decline in gloss over time, and that generates fewer image defects even when subjected to loading within the developing apparatus.

Further features of the present invention will become apparent from the following description of exemplary embodiments.

DESCRIPTION OF THE EMBODIMENTS

The toner according to the present invention is specifically described herebelow, but is not limited to or by this.

Unless specifically indicated otherwise, the expressions "from XX to YY" and "XX to YY" that show numerical value ranges refer in the present invention to numerical value ranges that include the lower limit and upper limit that are the end points.

In addition, monomer unit refers to the reacted form of a monomer material in the polymer or resin.

The toner is a toner including a toner particle that contains a binder resin, a resin represented by formula (1), and wax, wherein the wax contains an ester compound that exhibits a compatibility at 100° C. of at least 5.0 mass parts per 100.0 mass parts of the binder resin.

The present inventors discovered that, by adopting a toner having the constitution as described above, an excellent low-temperature fixability is provided, a fixed image which causes a smaller decline in gloss over time is obtained, and fewer image defects are generated even upon being subjected to loading within the developing apparatus.

The reasons for this are hypothesized as follows.

In the case of conventional toners that contain a plasticizer, since the toner is heated during fixing to at least the melting point of the plasticizer, fixing to the paper occurs while the melted plasticizer is compatibilized with the binder resin.

The fixed image undergoes a sharp drop in temperature, from the fixation temperature to around room temperature, during the process of paper discharge from the printer unit. The shortness of this time interval makes it easier for the plasticizer to be present as such in a state of compatibility in the binder, in comparison to nuclei formation and crystal growth while phase-separated from the binder resin.

The plasticizer present as such in a compatible state exhibits a higher mobility in the fixed image than plasticizer present in a crystallized state, and due to this migrates in the fixed image over time, thus facilitating externalization to the surface of the fixed image. The gloss of the fixed image is reduced by the plasticizer externalized to the surface in this manner.

On the contrary, the present toner particle contains the resin represented by formula (1) (also referred to as resin A in the following).

The macromolecular segment in the resin A is thought to have a high affinity for the binder resin, and the silicon atom present in the resin A is thought to have a high affinity for the ester group segment in the ester compound.

Due to this, in the state in which the toner has been melted during fixing and high mobilities are taken on by the various molecules in the toner, the silicon atoms readily orient to the ester group segment of the ester compound and the macromolecular segments readily orient to the binder resin.

At this time, the macromolecular segment oriented to the binder resin has a strong interaction with the binder resin, and this makes possible as a result restrictions on the mobility of the ester compound. It is thought that, due to this, the externalization to the surface of the fixed image by the ester compound over time can be inhibited, thus providing a fixed image that causes a smaller decline in gloss.

In addition, the resin A-containing toner particle is more resistant to cracking when subjected to loading than a conventional toner particle lacking resin A. As noted above, the silicon atom in the resin A readily orients to the ester group segment of the ester compound and the macromolecular segment readily orients to the binder resin. It is thought that this facilitates the presence of the resin A in the toner particle at the interface between the binder resin and the ester compound. When the toner is subjected to a load and the toner undergoes deformation, the interfacial adhesion between the binder resin and ester compound is improved by the resin A present at this interface, and it is thought that toner cracking is inhibited as a consequence. Toner cracking facilitates, for example, the generation of development streaks as an image defect.

As indicated in the preceding, a toner having the above-described effects can be obtained by having the toner particle contain a binder resin, the resin A, and an ester compound that exhibits a specific compatibility with the binder resin.

The toner particle contains the resin represented by the following formula (1).

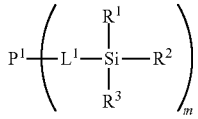

(1)

In formula (1), $P^1$ represents a macromolecular segment; $L^1$ represents a single bond or a divalent linking group; $R^1$ to $R^3$ each independently represent a hydrogen atom, halogen atom, alkyl group, alkoxy group, hydroxy group, or aryl group; and m represents a positive integer. When m is equal to or greater than 2, a plurality of $L^1$'s may be the same as or different from each other, a plurality of $R^1$'s may be the same as or different from each other, a plurality of $R^2$'s may be the same as or different from each other, and a plurality of $R^3$'s may be the same as or different from each other.

The silicon atom (Si) is present in a side chain position or terminal position of the resin in the resin represented by formula (1). It is thought that this silicon atom readily orients to the ester group segment due to the high affinity of this silicon atom for the ester group segment in the ester compound.

The content of the silicon atom in the resin represented by formula (1) is preferably from 0.02 mass % to 10.00 mass % and is more preferably from 0.02 mass % to 5.00 mass %.

The silicon atom in the resin A undergoes orientation with respect to the ester compound more readily when the silicon atom content in the resin represented by formula (1) (resin A) is at least 0.02 mass %.

On the other hand, the macromolecular segment (for example, a polymer segment) in the resin A more readily orients to the binder resin when the silicon atom content in the resin A is not more than 10.00 mass %. In addition, when the silicon atom content is not more than 5.00 mass %, the macromolecular segment even more readily undergoes orientation with respect to the binder resin. The method for measuring the silicon atom content in the resin A is described below.

$R^1$ to $R^3$ in formula (1) each independently represent a hydrogen atom, halogen atom, alkyl group, alkoxy group, hydroxy group, or aryl group.

The number of carbons in the alkyl group is preferably 1 to 4 and more preferably 1 to 3.

The number of carbons in the alkoxy group is preferably 1 to 4 and more preferably 1 to 3.

The number of carbons in the aryl group is preferably 6 to 12 and more preferably 6 to 10.

Among the preceding, at least one of the $R^1$ to $R^3$ in formula (1) preferably represents an alkoxy group or hydroxy group. More preferably, $R^1$ to $R^3$ in formula (1) each independently represent an alkoxy group or hydroxy group.

This alkoxy group and hydroxy group have a higher affinity for the ester group segment in the ester compound and orientation to the ester group segment is thus facilitated to an even greater degree. It is thought that as a result the mobility of the ester compound in the fixed image is restricted to a greater extent.

In order to have at least one of $R^1$ to $R^3$ in formula (1) be a hydroxy group, for example, a resin in which at least one of $R^1$ to $R^3$ is an alkoxy group may be subjected to hydrolysis in order to convert the alkoxy group to the hydroxy group.

Any method may be used for hydrolysis, and the following procedure is an example.

A resin in which at least one of $R^1$ to $R^3$ in formula (1) is an alkoxy group is dissolved or suspended in a suitable solvent (this may be a polymerizable monomer), the pH is adjusted to acidity using acid or alkali, and mixing and hydrolysis are carried out.

Hydrolysis may also be carried out during toner particle production.

The $P^1$ in formula (1) should have a macromolecular segment (for example, a polymer segment), but is not otherwise particularly limited. It is thought that this macromolecular segment exhibits a high affinity with the molecular chain of the binder resin, resulting in a greater increase in interaction with the molecular chain of the binder resin and an inhibitory effect on the mobility of the ester compound.

The following are specific examples of the macromolecular segment in formula (1): polyester segments, vinyl polymer segments such as styrene-acrylic acid copolymers, polyurethane segments, polycarbonate segments, phenolic resin segments, and polyolefin segments.

The macromolecular segment preferably contains, among the preceding, a styrene-acrylic acid copolymer segment or a polyester segment.

The presence of a styrene-acrylic acid copolymer segment in the macromolecular segment means that the macromolecular segment may be composed of only a styrene-acrylic acid copolymer, or may be a block copolymer or graft copolymer of a styrene-acrylic acid copolymer with another polymer or a mixture of the preceding.

The styrene-acrylic acid copolymer here denotes a copolymer of a styrenic monomer with at least one monomer selected from the group consisting of acrylic acid monomers and methacrylic acid monomers.

The styrenic monomer can be exemplified by styrene, α-methylstyrene, β-methylstyrene, o-methylstyrene, m-methylstyrene, p-methylstyrene, 2,4-dimethylstyrene, and divinylbenzene. A single species of styrenic monomer may be used or a combination of two or more species selected from among styrenic monomers may be used.

The acrylic acid monomer can be exemplified by alkyl acrylate esters such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, and n-nonyl acrylate; acrylate diesters, e.g., diethylene glycol diacrylate, triethylene glycol diacrylate, tetraethylene glycol diacrylate, polyethylene glycol diacrylate, and 1,6-hexanediol diacrylate; and acrylic acid.

The methacrylic acid monomer can be exemplified by alkyl methacrylate esters such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, and n-nonyl methacrylate; and by methacrylic acid.

A single species of acrylic acid monomer can be used or a combination of two or more species selected from acrylic acid monomers can be used, and a single species of methacrylic acid monomer can be used or a combination of two or more species selected from methacrylic acid monomers can be used.

The styrene-acrylic acid copolymer segment preferably contains a styrene-alkyl acrylate ester copolymer or a styrene-alkyl methacrylate ester copolymer.

The proportion of the styrenic monomer in the total monomer forming the styrene-acrylic acid copolymer is preferably from 45 mass % to 80 mass %. On the other hand, the proportion of the at least one monomer selected from the group consisting of acrylic acid monomers and methacrylic acid monomers (for example, alkyl acrylate esters and/or alkyl methacrylate esters) is preferably from 20 mass % to 50 mass %.

Further descriptions are provided for embodiments of the case in which the macromolecular segment contains a polyester segment; however, this should not be construed as a limitation thereto.

The polyester segment refers to a macromolecular segment that has the ester bond (—CO—O—) in a main chain repeat unit. An example here is a condensation polymer structure between a polyhydric alcohol (alcohol component) and a polyvalent carboxylic acid (carboxylic acid component). Specific examples are macromolecular segments in which a structure represented by the following formula (6) (structure derived from a dicarboxylic acid) is bonded, with the formation of an ester bond, with at least one structure (structure derived from a diol) selected from the group consisting of the formulas (7) to (9) given below. This may also be a macromolecular segment in which a structure represented by the formula (10) given below (structure derived from a compound having a carboxy group and a hydroxy group in the single molecule) is bonded with the formation of an ester bond.

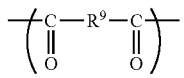

(6)

(In formula (6), $R^9$ represents an alkylene group, alkenylene group, or arylene group.)

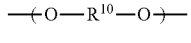

(7)

(In formula (7), $R^{10}$ represents an alkylene group or a phenylene group.)

(8)

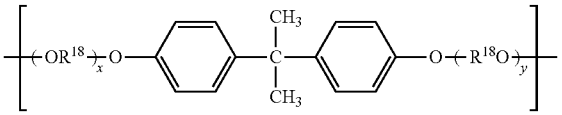

(In formula (8), $R^{18}$ represents an ethylene group or propylene group. x and y are each an integer with a value equal to or greater than 0, and the average value of x+y is 2 to 10.)

(9)

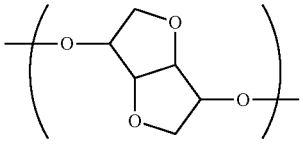

(10)

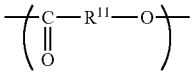

(In formula (10), $R^{11}$ represents an alkylene group or alkenylene group.)

The alkylene group (preferably having 1 to 12 carbons) represented by $R^9$ in formula (6) can be exemplified by the following:

methylene group, ethylene group, trimethylene group, propylene group, tetramethylene group, hexamethylene group, neopentylene group, heptamethylene group, octamethylene group, nonamethylene group, decamethylene group, undecamethylene group, dodecamethylene group, 1,3-cyclopentylene, 1,3-cyclohexylene, and 1,4-cyclohexylene group.

The alkenylene group (preferably having 2 to 4 carbons) represented by $R^9$ in formula (6) can be exemplified by the vinylene group, propenylene group, and 2-butenylene group.

The arylene group (preferably having 6 to 12 carbons) represented by $R^9$ in formula (6) can be exemplified by the 1,4-phenylene group, 1,3-phenylene group, 1,2-phenylene group, 2,6-naphthylene group, 2,7-naphthylene group, and 4,4'-biphenylene group.

$R^9$ in formula (6) may be substituted by a substituent. Examples of the substituent in such a case are the methyl group, halogen atoms, carboxy group, trifluoromethyl group, and their combinations.

The alkylene group (preferably having 1 to 12 carbons) represented by $R^{10}$ in formula (7) can be exemplified by the following:

methylene group, ethylene group, trimethylene group, propylene group, tetramethylene group, hexamethylene group, neopentylene group, heptamethylene group, octamethylene group, nonamethylene group, decamethylene group, undecamethylene group, dodecamethylene group, 1,3-cyclopentylene, 1,3-cyclohexylene, and 1,4-cyclohexylene group.

The phenylene group represented by $R^{10}$ in formula (7) can be exemplified by the 1,4-phenylene group, 1,3-phenylene group, and 1,2-phenylene group.

$R^{10}$ in formula (7) may be substituted by a substituent. Examples of the substituent in such a case are the methyl group, alkoxy groups, hydroxy group, halogen atoms, and their combinations.

The alkylene group (preferably having 1 to 12 carbons) represented by $R^{11}$ in formula (10) can be exemplified by the following:

methylene group, ethylene group, trimethylene group, propylene group, tetramethylene group, hexamethylene group, neopentylene group, heptamethylene group, octamethylene group, nonamethylene group, decamethylene group, undecamethylene group, dodecamethylene group, and 1,4-cyclohexylene group.

The alkenylene group (preferably having 2 to 40 carbons) represented by $R^{11}$ in formula (10) can be exemplified by the following:

vinylene group, propenylene group, butenylene group, butadienylene group, pentenylene group, hexenylene group, hexadienylene group, heptenylene group, octenylene group, decenylene group, octadecenylene group, eicosenylene group, and triacontenylene group.

These alkenylene groups may have any of the following structures: straight chain, branched, and cyclic. The position of the double bond may be at any location, and at least one or more double bonds may be present.

$R^{11}$ in formula (10) may be substituted by a substituent. Examples of the substituent in such a case are alkyl groups, alkoxy groups, hydroxy groups, halogen atoms, and combinations of the preceding.

The polyvalent carboxylic acid (carboxylic acid component), on the other hand, can be exemplified by the following carboxylic acids:

dibasic carboxylic acids such as maleic acid, fumaric acid, citraconic acid, itaconic acid, glutaconic acid, phthalic acid, isophthalic acid, terephthalic acid, 2,6-naphthalenedicarboxylic acid, succinic acid, adipic acid, sebacic acid, azelaic acid, and malonic acid. Preferred among these are maleic acid, fumaric acid, and terephthalic acid.

The at least tribasic carboxylic acids can be exemplified by the following:

1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and Empol trimer acid and the anhydrides and lower alkyl esters of the preceding.

A single one of these dibasic carboxylic acids may be used or two or more may be used in combination, and a single one of these at least tribasic carboxylic acids may be used or two or more may be used in combination.

A stronger affinity between the macromolecular segment and the binder resin is exhibited when the macromolecular segment with formula (1) and the binder resin are the same type of structure.

Thus, when the binder resin is a resin that contains a styrene-acrylic acid copolymer and the macromolecular segment contains a styrene-acrylic acid copolymer, or when the binder resin is a resin that contains a polyester segment and the macromolecular segment contains a polyester segment, the above-described affinity becomes even greater and due to this the movement of the ester compound in the fixed image can be more thoroughly inhibited.

$L^1$ represents a single bond or a divalent linking group. The divalent linking group is not particularly limited, but can be exemplified by alkylene groups, phenylene groups, and the structures given below by formulas (2), (3), (4), and (5). In addition, the divalent linking group is preferably a structure represented by the following formula (2), (3), (4), or (5).

The alkylene groups and phenylene groups may be substituted with a substituent. Such a substituent can be exemplified by the methyl group, alkoxy groups, the hydroxy group, halogen atoms, and combinations of the preceding. The alkylene group preferably has 1 to 12 carbons and more preferably 1 to 4 carbons.

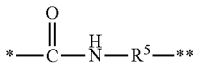

(2)

(In formula (2), the (*) represents a bonding segment to the $P^1$, and the (**) represents a bonding segment to the silicon atom (Si), and $R^5$ represents a single bond, an alkylene group, or an arylene group.)

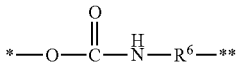

(3)

(In formula (3), the (*) represents a bonding segment to the $P^1$, and the (**) represents a bonding segment to the silicon atom (Si), and $R^6$ represents a single bond, an alkylene group, or an arylene group.)

For $R^5$ and $R^6$, the number of carbons in the alkylene group is preferably 1 to 12 and more preferably 1 to 3.

The number of carbons in the arylene group is preferably 6 to 12 and more preferably 6 to 10.

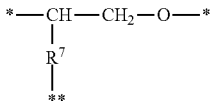

(4)

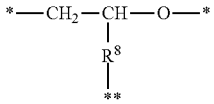

(5)

($R^7$ and $R^8$ in formulas (4) and (5) each independently represent a single bond, an alkylene group, an arylene group, or an oxyalkylene group. The (*) represents a bonding segment to the $P^1$ in formula (1), and the (**) represents a bonding segment to the silicon atom (Si) in formula (1).)

For $R^7$ and $R^8$, the number of carbons in the alkylene group is preferably 1 to 12 and more preferably 1 to 3.

The number of carbons in the arylene group is preferably 6 to 12 and more preferably 6 to 10.

The number of carbons in the oxyalkylene group is preferably 1 to 12 and more preferably 1 to 3.

The structure represented by formula (2) is a divalent linking group that contains an amide bond.

This linking group is not limited to the case of formation by reaction. In the case of the formation of the linking group by reaction to produce the resin represented by formula (1), for example, a carboxy group-bearing compound may be reacted with an aminosilane compound (for example, a compound containing the amino group and an alkoxysilyl group, a compound containing the amino group and an alkylsilyl group, and so forth).

The aminosilane compound is not particularly limited, but can be exemplified by γ-aminopropyltriethoxysilane, γ-aminopropyltrimethoxysilane, N-β-(aminoethyl)-γ-aminopropyltrimethoxysilane, N-β-(aminoethyl)-γ-aminopropylmethyldimethoxysilane, N-phenyl-γ-aminopropyltriethoxysilane, N-phenyl-γ-aminopropyltrimethoxysilane, N-β-(aminoethyl)-γ-aminopropyltriethoxysilane, N-6-(aminohexyl)-3-aminopropyltrimethoxysilane, 3-aminopropyltrimethylsilane, and 3-aminopropylsilicone.

The alkylene group encompassed by $R^5$ in formula (2) may be an alkylene group that contains the —NH— group.

The structure given by formula (3) is a urethane bond-bearing divalent linking group.

This linking group is not limited to the case of formation by reaction. In the case of the formation of the linking group by reaction to produce the resin represented by formula (1), for example, formation may be carried out by reacting a hydroxy group-bearing compound with an isocyanatosilane compound (for example, a compound containing the isocyanate group and an alkoxysilyl group, a compound containing the isocyanate group and an alkylsilyl group, and so forth).

The isocyanatosilane compound is not particularly limited, but can be exemplified by 3-isocyanatopropyltrimethoxysilane, 3-isocyanatopropylmethyldimethoxysilane, 3-isocyanatopropyldimethylmethoxysilane, 3-isocyanatopropyltriethoxysilane, 3-isocyanatopropylmethyldiethoxysilane, 3-isocyanatopropyldimethylethoxysilane, and 3-isocyanatopropyltrimethylsilane.

The structures represented by formulas (4) and (5) are divalent linking groups that contain bonds that are grafted to the ester bond in the polymer.

These linking groups are not limited to the case of formation by reaction. In the case of the formation of the linking group by reaction to produce the resin represented by formula (1), for example, formation may be carried out by an insertion reaction of an epoxy group-bearing silane compound. The insertion reaction of the epoxy group-bearing silane compound is the reaction indicated below.

Included here is a step of carrying out the insertion reaction of the epoxy group of an epoxy group-bearing silane compound into an ester bond present in the polymer main chain.

The insertion reaction referenced here is the reaction described as, for example, "Addition Reaction of Epoxy Compounds with Esters and Its Application for Polymer Syntheses", Journal of Synthetic Organic Chemistry, Japan, Volume 49, Number 3, page 218, 1991.

The following formula (A) shows the mechanism of this reaction as a simple model formula.

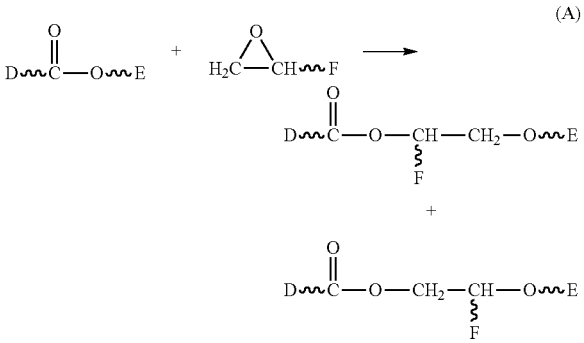

(A)

(In formula (A), D and E represent constituent portions of the polymer, and F represents the constituent portion of the epoxy group-bearing silane compound excluding the epoxy moiety.)

Two types of compounds are possible arising from α-cleavage and β-cleavage in the ring-opening of the epoxy group in formula (A), but both represent a mode of epoxy group insertion into the ester bond in the polymer, i.e., a mode for the grafting, into the polymer segment, of the constituent portion of the epoxy group-bearing silane compound excluding the epoxy moiety.

The epoxy group-bearing silane compound is not particularly limited, but can be exemplified by β-(3,4-epoxycyclohexyl)ethyltrimethoxysilane, γ-glycidoxypropyltrimethoxysilane, γ-glycidoxypropylmethyldiethoxysilane, and 5,6-epoxyhexyltrimethylsilane.

A single species of resin represented by formula (1) may be incorporated or a combination of two or more species may be incorporated.

The weight-average molecular weight (Mw) of the resin with formula (1) is preferably from 3000 to 100000 and is more preferably from 5000 to 30000.

When the weight-average molecular weight is at least 3000, a satisfactory affinity is then exhibited between the macromolecular segment ($P^1$) in formula (1) and the molecular chain of the binder resin and the externalization of the ester compound in the fixed image to the surface of the fixed image can be better inhibited.

On the other hand, the orientability in the fixed image of the silicon atom in formula (1) to the ester group segment in the ester compound can be further increased when the weight-average molecular weight is not more than 100000. The method for measuring this weight-average molecular weight (Mw) is described below.

The content of the resin represented by formula (1) in the total resin in the toner particle is preferably at least 0.4 mass %, or at least 0.9 mass %, or at least 6.0 mass %. This content is preferably not more than 20.0 mass %, or not more than 35.0 mass %, or not more than 50.0 mass %, or not more than 95.0 mass %. Any combination of these numerical value ranges may be used.

The toner particle contains a binder resin. The binder resin is the resin component in the toner particle other than the resin given by formula (1). The content of the binder resin in the total resin of the toner particle is preferably at least 5.0 mass %, or at least 50.0 mass %, or at least 65.0 mass %, or at least 80.0 mass %. The content is preferably not more than 94.0 mass %, or not more than 99.1 mass %, or not more than 99.6 mass %. Any combination of these numerical value ranges may be used.

There are no particular limitations on this binder resin, and heretofore known binder resins can be used.

Viewed from the perspective of the developing characteristics and durability of the toner, the binder resin is preferably a resin comprising a styrene-acrylic acid copolymer or is preferably a resin comprising a polyester segment.

The resin comprising a styrene-acrylic acid copolymer may, if it has a styrene-acrylic acid copolymer, be a resin composed of only a styrene-acrylic acid copolymer, or may be a block copolymer or graft copolymer of a styrene-acrylic acid copolymer with another polymer or a mixture of the preceding.

The styrene-acrylic acid copolymer here denotes a copolymer of a styrenic monomer with at least one monomer selected from the group consisting of acrylic acid monomers and methacrylic acid monomers.

The styrenic monomer can be exemplified by styrene, α-methylstyrene, β-methylstyrene, o-methylstyrene, m-methylstyrene, p-methylstyrene, 2,4-dimethylstyrene, and divinylbenzene. A single species of styrenic monomer may be used or a combination of two or more species selected from among styrenic monomers may be used.

The acrylic acid monomer can be exemplified by alkyl acrylate esters such as methyl acrylate, ethyl acrylate, n-propyl acrylate, isopropyl acrylate, n-butyl acrylate, isobutyl acrylate, tert-butyl acrylate, n-amyl acrylate, n-hexyl acrylate, 2-ethylhexyl acrylate, n-octyl acrylate, and n-nonyl acrylate; acrylate diesters, e.g., diethylene glycol diacrylate, triethylene glycol diacrylate, tetraethylene glycol diacrylate, polyethylene glycol diacrylate, and 1,6-hexanediol diacrylate; and acrylic acid.

The methacrylic acid monomer can be exemplified by alkyl methacrylate esters such as methyl methacrylate, ethyl methacrylate, n-propyl methacrylate, isopropyl methacrylate, n-butyl methacrylate, isobutyl methacrylate, tert-butyl methacrylate, n-amyl methacrylate, n-hexyl methacrylate, 2-ethylhexyl methacrylate, n-octyl methacrylate, and n-nonyl methacrylate; and by methacrylic acid.

A single species of acrylic acid monomer can be used or a combination of two or more species selected from acrylic acid monomers can be used, and a single species of methacrylic acid monomer can be used or a combination of two or more species selected from methacrylic acid monomers can be used.

The resin comprising a styrene-acrylic acid copolymer preferably contains a styrene-alkyl acrylate ester copolymer or a styrene-alkyl methacrylate ester copolymer.

The proportion of the styrenic monomer in the total monomer forming the styrene-acrylic acid copolymer is preferably from 45 mass % to 80 mass %. On the other hand, the proportion of the at least one monomer selected from the group consisting of acrylic acid monomers and methacrylic acid monomers (for example, alkyl acrylate esters and/or alkyl methacrylate esters) is preferably from 20 mass % to 50 mass %.

Condensation polymers between the hereafter-exemplified carboxylic acid components and alcohol components can be used as the resin comprising a polyester segment. The carboxylic acid component can be exemplified by terephthalic acid, isophthalic acid, phthalic acid, fumaric acid, maleic acid, cyclohexanedicarboxylic acid, and trimellitic acid. The alcohol component can be exemplified by bisphenol A, hydrogenated bisphenols, ethylene oxide adducts on bisphenol A, propylene oxide adducts on bisphenol A, glycerol, trimethylolpropane, and pentaerythritol.

In addition, the polyester segment may be a urea group-containing polyester. Preferably the carboxy groups, e.g., in terminal position and so forth, of the polyester are not capped.

The content in the binder resin of resin containing a styrene-acrylic acid copolymer or resin containing a polyester segment is preferably from 50.0 mass % to 100.0 mass % and is more preferably from 80.0 mass % to 100.0 mass %. When the content is in the indicated range, the plasticizing effect for the binder resin by the below-described ester compound is then satisfactory and an excellent low-temperature fixability is exhibited. A single one of these binder resins or a mixture may be used.

The binder resin may contain a crosslinking agent. The elasticity of the toner can be increased by the incorporation of a crosslinking agent. It is thought that when the elasticity of the toner is sufficiently high, an inhibitory effect on sticking by the plasticized toner to the fixing roller can be expected—even when the binder resin and ester compound are compatibilized and there is a large plasticizing effect for the binder resin—and the low-temperature fixability will be further increased.

Compounds having two or more polymerizable double bonds are mainly used as the crosslinking agent.

Examples are aromatic divinyl compounds such as divinylbenzene and divinylnaphthalene; carboxylate esters having two double bonds, such as ethylene glycol diacrylate, ethylene glycol dimethacrylate, 1,3-butanediol dimethacrylate, and 1,6-hexanediol diacrylate; divinyl compounds such as divinylaniline, divinyl ether, divinyl sulfide, and divinyl sulfone; and compounds that have three or more vinyl groups.

A single one of these may be used or a mixture of two or more may be used. The content of the crosslinking agent is preferably from 0.001 mass parts to 15.000 mass parts per 100 mass parts of the binder resin.

The toner particle contains a wax. This wax contains an ester compound that exhibits a compatibility at 100° C. of at least 5.0 mass parts per 100 mass parts of the binder resin.

The compatible amount at 100° C. per 100 mass parts of the binder resin is also referred to herebelow as the saturation compatible amount.

The saturation compatible amount is a numerical value that indicates how much of the ester compound can compatibilize into the binder resin and is regarded as being indicative of the compatibility between the binder resin and ester compound.

For the same amount of ester compound present in the toner particle, an ester compound having a larger saturation compatible amount will have a larger effect on the low-temperature fixability.

The ester compound has a saturation compatible amount of at least 5.0 mass parts and preferably at least 9.0 mass parts, more preferably at least 14.0 mass parts, and still more preferably at least 25.0 mass parts. The upper limit for the saturation compatible amount, on the other hand, is not particularly limited, but not more than 100.0 mass parts is preferred, not more than 50.0 mass parts is more preferred, and not more than 45.0 mass parts is still more preferred. Any combination of these numerical value ranges may be used.

When the saturation compatible amount satisfies the conditions indicated above, a satisfactory plasticizing effect by the ester compound for the binder resin is then obtained and an excellent low-temperature fixability will be displayed.

The saturation compatible amount can be adjusted using the solubility parameter (SP value) of the ester compound and using its molecular weight.

Using $SP_W$ for the SP value of the ester compound, $SP_C$ for the SP value of the binder resin, and Mw for the weight-average molecular weight of the ester compound, this $SP_W$, $SP_C$, and Mw preferably satisfy the following formula (I) relationship (wherein the unit for the solubility parameter is $(cal/cm^3)^{1/2}$).

$$[(SP_C-SP_W)^2\times Mw]\leq 960 \quad (I)$$

$[(SP_C-SP_W)^2\times Mw]$ is more preferably at least 370, or at least 390, or at least 420, or at least 440, and is more preferably not more than 950, or not more than 800, or not more than 720, or not more than 536. Any combination of these numerical value ranges may be used. For example, $370\leq[(SP_C-SP_W)^2\times Mw]\leq 960$.

The unit for the solubility parameter (SP value) is $(cal/cm^3)^{1/2}$.

A satisfactory compatibility by the ester compound for the binder resin can be brought about by using an ester compound for which $[(SP_C-SP_W)^2\times Mw]$ satisfies the indicated range. The method for measuring the saturation compatible amount, the method for calculating the SP value, and the method for measuring the weight-average molecular weight are described below.

The melting point of the ester compound is preferably from 55° C. to 100° C., more preferably from 60° C. to 100° C., and still more preferably from 60° C. to 90° C. When the melting point of the ester compound is at least 55° C., the generation of wraparound at the fixing roller during fixing is suppressed; a satisfactory low-temperature fixability can be obtained at equal to or less than 100° C.

Insofar as the ester compound satisfies the conditions indicated above, there are no particular limitations thereon and known ester compounds can be used. For example, ester compounds that are the condensate of an alcohol component and a carboxylic acid component are preferred for their excellent compatibility with respect to the styrene-acrylic acid copolymer or polyester segment present in the binder resin.

This ester compound can be exemplified by the following: condensates between an aliphatic monoalcohol having from 18 to 22 carbons and an aliphatic monocarboxylic acid having from 18 to 22 carbons, condensates between an aliphatic monoalcohol having from 18 to 22 carbons and an aliphatic dicarboxylic acid or aromatic dicarboxylic acid having from 6 to 10 carbons, condensates between an aliphatic diol having from 2 to 10 carbons and an aliphatic monocarboxylic acid having from 14 to 22 carbons, and condensates between diethylene glycol and an aliphatic monocarboxylic acid having 18 to 22 carbons.

Among the preceding, condensates between an aliphatic diol having from 2 to 10 carbons and an aliphatic monocarboxylic acid having from 14 to 22 carbons are preferred and condensates between a diol having from 2 to 6 carbons and an aliphatic monocarboxylic acid having from 14 to 22 carbons are more preferred.

The diol having from 2 to 6 carbons can be exemplified by ethylene glycol, diethylene glycol, 1,3-propanediol, 1,4-butanediol, and 1,6-hexanediol.

The aliphatic monocarboxylic acid having from 14 to 22 carbons can be exemplified by myristic acid, palmitic acid, stearic acid, and behenic acid.

Ethylene glycol distearate, which is an ester compound between ethylene glycol and stearic acid, is particularly preferred.

The number of carbons in the diol component and the number of carbons in the monocarboxylic acid of the ester compound can be determined by analysis of the toner particle by pyrolysis GC/MS. As necessary, analysis can be facilitated by preliminary derivatization using, for example, a methylating agent.

The content of the ester compound, per 100.0 mass parts of the binder resin, is preferably from 5.0 mass parts to 30.0 mass parts, more preferably from 7.0 mass parts to 30.0 mass parts, and still more preferably from 7.0 mass parts to 20.0 mass parts.

A better plasticizing effect for the binder resin is provided and an excellent low-temperature is exhibited when the ester compound content is in the indicated range. Moreover, because the plasticizing effect for the binder resin is not excessive and the viscosity of the binder resin during fixing does not undergo an excessive decline, the adhesiveness for paper is then excellent and the occurrence of wraparound during fixing is suppressed. The ester compound content can be determined by $^{13}$C-NMR analysis in which the toner particle is dissolved using a solvent such as deuterochloroform.

Using A for the content in mass % of the ester compound in the toner and using B for the content in mass % in the toner of the resin given by formula (1), the ratio of B to A (B/A) is preferably from 0.10 to 10.00 and is more preferably from 0.10 to 2.00. The externalization of the ester compound to the surface of the fixed image can be more completely suppressed when B/A is in the indicated range. In addition, the ester compound can engage in a better plasticization of the binder resin and the low-temperature fixability can be further improved. The method for calculating B/A is described below.

In order to bring about an enhancement in the releasability from paper, the toner particle may optionally contain a wax other than the aforementioned ester compound. This wax is not particularly limited and can be exemplified by the following waxes:

aliphatic hydrocarbon waxes such as low molecular weight polyethylene, low molecular weight polypropylene, microcrystalline wax, Fischer-Tropsch wax, and paraffin wax; the oxides of aliphatic hydrocarbon waxes, e.g., oxidized polyethylene wax, and their block copolymers; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinyl monomer such as styrene or acrylic acid. A single one of these waxes may be used or a combination of two or more may be used.

The incorporation of a hydrocarbon wax is preferred among the preceding.

The content of the wax other than the ester compound is preferably from 0.5 mass parts to 20.0 mass parts per 100.0 mass parts of the binder resin.

The toner particle may contain a colorant. There are no particular limitations on this colorant, and, for example, the following known colorants can be used.

Examples of yellow pigments include yellow iron oxide and condensed azo compounds such as Navels Yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake, and the like, isoindolinone compounds, anthraquinone compounds, azo metal complexes, methine compounds, and allylamide compounds. Specific examples are presented hereinbelow.

C. I. Pigment Yellow 12, 13, 14, 15, 17, 62, 74, 83, 93, 94, 95, 109, 110, 111, 128, 129, 147, 155, 168, 180.

Examples of orange pigments are presented below.

Permanent Orange GTR, Pyrazolone Orange, Vulcan Orange, Benzidine Orange G, Indanthrene Brilliant Orange RK, and Indathrene Brilliant Orange GK.

Examples of red pigments include Indian Red, condensation azo compounds such as Permanent Red 4R, Lithol Red, Pyrazolone Red, Watching Red calcium salt, Lake Red C, Lake Red D, Brilliant Carmine 6B, Brilliant Carmine 3B, Eosin Lake, Rhodamine Lake B, Alizarin Lake and the like, diketopyrrolopyrrole compounds, anthraquinone compounds, quinacridone compounds, basic dye lake compounds, naphthol compounds, benzimidazolone compounds, thioindigo compounds, perylene compounds. Specific examples are presented hereinbelow.

C. I. Pigment Red 2, 3, 5, 6, 7, 23, 48:2, 48:3, 48:4, 57:1, 81:1, 122, 144, 146, 166, 169, 177, 184, 185, 202, 206, 220, 221, 254.

Examples of blue pigments include copper phthalocyanine compounds and derivatives thereof such as Alkali Blue Lake, Victoria Blue Lake, Phthalocyanine Blue, metal-free Phthalocyanine Blue, partial Phthalocyanine Blue chloride, Fast Sky Blue, Indathrene Blue BG and the like, anthraquinone compounds, basic dye lake compound and the like. Specific examples are presented hereinbelow.

C. I. Pigment Blue 1, 7, 15, 15:1, 15:2, 15:3, 15:4, 60, 62, 66.

Examples of purple pigments include Fast Violet B and Methyl Violet Lake.

Examples of green pigments include Pigment Green B, Malachite Green Lake, and Final Yellow Green G. Examples of white pigments include zinc white, titanium oxide, antimony white and zinc sulfide.

Examples of black pigments include carbon black, aniline black, non-magnetic ferrites, magnetite, and those which are colored black by using the abovementioned yellow colorant, red colorant and blue colorant. These colorants can be used singly or in a mixture, or in the form of a solid solution.

If necessary, the colorant may be surface-treated.

The amount of the colorant is preferably from 1.0 parts by mass to 15.0 parts by mass with respect to 100.0 parts by mass of the binder resin.

The toner particle may contain a charge control agent. A known charge control agent may be used as this charge control agent. In particular, a charge control agent is preferred that provides a fast charging speed and that can stably maintain a certain amount of charge. When the toner particle is produced by a direct polymerization method, a charge control agent that has little ability to inhibit polymerization and that substantially lacks material elutable into aqueous media is particularly preferred.

Charge control agents that control the toner particle to negative charging are exemplified by the following:

organometal compounds and chelate compounds such as monoazo metal compounds, acetylacetone/metal compounds, and metal compounds of aromatic oxycarboxylic acids, aromatic dicarboxylic acids, oxycarboxylic acids, and dicarboxylic acid systems. Also otherwise included are aromatic oxycarboxylic acids and aromatic mono- and polycarboxylic acids and their metal salts, anhydrides, and esters; also, phenol derivatives such as bisphenols. Additional examples are urea derivatives, metal-containing salicylic acid compounds, metal-containing naphthoic acid compounds, boron compounds, quaternary ammonium salts, and calixarene.

Charge control agents that control the toner particle to positive charging, on the other hand, are exemplified by the following:

nigrosine and nigrosine modifications such as the fatty acid metal salts; guanidine compounds; imidazole compounds; quaternary ammonium salts such as tributylbenzylammonium-1-hydroxy-4-naphthosulfonate and tetrabutylammonium tetrafluoroborate and onium salts such as phosphonium salts that are their analogs, and their lake pigments; triphenylmethane dyes and their lake pigments (the laking agent is exemplified by phosphotungstic acid, phosphomolybdic acid, phosphotungstomolybdic acid, tannic acid, lauric acid, gallic acid, ferricyanide, and ferrocyanide); the metal salts of higher fatty acids; and resin-type charge control agents.

A single one of these charge control agents can be incorporated or two or more can be incorporated in combination. The amount of the charge control agent is preferably from 0.01 mass parts to 10 mass parts per 100 mass parts of the binder resin.

The toner particle may also be used as such as a toner, but in order to improve, for example, the flowability, charging performance, and cleanability, the toner particle may be made into a toner through the addition of so-called external additives, e.g., a fluidizing agent and cleaning aid.

The external additive can be exemplified by inorganic oxide fine particles such as silica fine particles, alumina fine particles, and titanium oxide fine particles; inorganic/stearic acid compound fine particles such as aluminum stearate fine particles and zinc stearate fine particles; and inorganic titanic acid compound fine particles such as strontium titanate and zinc titanate. A single one of these may be used by itself or a combination of two or more may be used.

In order to enhance the heat-resistant storability and enhance the environmental stability, the inorganic fine particle may be subjected to a surface treatment with, for example, a silane coupling agent, titanium coupling agent, higher fatty acid and silicone oil. The BET specific surface area of the external additive is preferably from 10 $m^2/g$ to 450 $m^2/g$.

The BET specific surface area can be determined according to the BET method (preferably the BET multipoint method) using a cryogenic gas adsorption procedure based on a dynamic constant pressure procedure. For example, using a specific surface area analyzer (product name: Gemini 2375 Ver. 5.0, Shimadzu Corporation), the BET specific surface area ($m^2/g$) can be calculated by measurement carried out using the BET multipoint method and adsorption of nitrogen gas to the sample surface.

With regard to the amount of these various external additives, their sum, per 100 mass parts of the toner particle, is preferably from 0.05 mass parts to 10 mass parts and more preferably from 0.1 mass parts to 5 mass parts. Combinations of the various external additives may be used as the external additive.

The toner according to the present invention may be used as a magnetic or nonmagnetic single-component developer, but may also be used mixed with a carrier as a two-component developer.

Magnetic body comprising a known material, for example, a metal such as iron, ferrite, or magnetite, or an alloy of these metals with a metal such as aluminum or lead, can be used as the carrier. Among these, the use of ferrite particles is preferred. In addition, a coated carrier as provided by coating the surface of a magnetic body with a coating agent such as a resin, or a resin-dispersed carrier as provided by the dispersion of magnetic fine particles in a binder resin, may be used as the carrier.

The volume-average particle diameter of the carrier is preferably from 15 μm to 100 μm and is more preferably from 25 μm to 80 μm.

A known means can be used for the method of producing the toner particle. For example, a dry production method, i.e., a kneading pulverization method, or a wet production method can be used. The use of a wet production method is preferred from the standpoint of shape controllability and achieving a more uniform particle diameter. The wet production method can be exemplified by the suspension polymerization method, the dissolution suspension method, the emulsion polymerization and aggregation method, and the emulsion aggregation method.

For example, when the toner particle is produced by a kneading pulverization method, the binder resin, a resin represented by formula (1), and wax, and optionally a colorant, charge control agent, and other additives are thoroughly mixed using a mixer, e.g., a Henschel mixer, ball mill, and so forth. After this, the toner particle is obtained by melt-kneading using a heated kneader, such as a hot roll, kneader, or extruder, to disperse or dissolve the various materials, and by a cooling and solidification step, a pulverization step, a classification step, and optionally a surface treatment step.

A known pulverization apparatus, e.g., a mechanical impact system, jet system, and so forth, may be used in the pulverization step. With regard to the sequence of the classification step and the surface treatment step, either may go before the other. The classification step preferably uses a multi-grade classifier based on productivity considerations.

Toner particle production by the suspension polymerization method, which is a wet production method, is described in the following.

Individual steps in an example of toner particle production using the suspension polymerization method are described in the following, but this should not be taken to mean that the present invention is limited thereby.

Step of Preparing the Polymerizable Monomer Composition

A polymerizable monomer composition is first obtained in the suspension polymerization method; this is done by dissolving or dispersing the following to uniformity using a disperser such as a ball mill or an ultrasound disperser: polymerizable monomer for producing the binder resin, the resin given by formula (1), and wax and optionally colorant, charge control agent, crosslinking agent, polymerization initiator, and other additives. The polymerizable monomer here can be exemplified by the monomers provided as examples of monomers for forming the previously described styrene-acrylic acid copolymer.

Step of Dispersing the Polymerizable Monomer Composition (Granulation Step)

This polymerizable monomer composition is then introduced into a preliminarily prepared aqueous medium and droplets of the polymerizable monomer composition are granulated, so as to provide the desired toner particle size, using a disperser or stirrer that generates a high shear force (granulation step).

The aqueous medium in the granulation step preferably contains a dispersion stabilizer in order to control the particle diameter of the toner particle, sharpen its particle size distribution, and suppress agglomeration of the toner particles during the production process.

Dispersion stabilizers may be broadly classified into polymers, which generally develop a repulsive force through steric hindrance, and sparingly water-soluble inorganic compounds, which support dispersion stabilization through an electrostatic repulsive force.

Fine particles of a sparingly water-soluble inorganic compound, because they are dissolved by acid or alkali, are preferably used because they can be easily removed after polymerization by dissolution by washing with acid or alkali.

A dispersion stabilizer containing magnesium, calcium, barium, zinc, aluminum, or phosphorus is preferably used for the sparingly water-soluble inorganic compound dispersion stabilizer. This dispersion stabilizer more preferably contains magnesium, calcium, aluminum, or phosphorus. Specific examples are as follows:

magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatite.

When such a sparingly water-soluble inorganic dispersing agent is used, it may be used as such, or, in order to obtain even finer particles, use may be made of inorganic dispersing agent particles that have been produced in the aqueous medium. Using the case of tricalcium phosphate as an example, an aqueous sodium phosphate solution may be mixed with an aqueous calcium chloride solution under high-speed stirring to produce water-insoluble calcium phosphate, thus enabling a more uniform and finer dispersion.

An organic compound, for example, polyvinyl alcohol, gelatin, methyl cellulose, methylhydroxypropyl cellulose, ethyl cellulose, the sodium salt of carboxymethyl cellulose, or starch, may be co-used in this dispersion stabilizer. The dispersion stabilizer is preferably used at from 0.1 mass parts to 20.0 mass parts per 100 mass parts of the polymerizable monomer.

In order to microfine-size the dispersion stabilizer, from 0.1 mass parts to 10.0 mass parts of a surfactant may be co-used per 100 mass parts of the polymerizable monomer. In specific terms, a commercial nonionic, anionic, or cationic surfactant can be used. Examples are sodium dodecyl sulfate, sodium tetradecyl sulfate, sodium pentadecyl sulfate, sodium octyl sulfate, sodium oleate, sodium laurate, potassium stearate, and calcium oleate.

Polymerization Step

Either after the granulation step or while the granulation step is being carried out, preferably the temperature is set to from 50° C. to 90° C. and the polymerizable monomer present in the polymerizable monomer composition is polymerized to obtain a toner particle dispersion.

A stirring operation may be carried out during the polymerization step so as to provide a uniform temperature distribution within the vessel. When a polymerization initiator is added, this can be carried out using any timing and at the required time. In addition, the temperature may be increased in the latter half of the polymerization reaction with the goal of obtaining a desired molecular weight distribution. In order to remove, e.g., unreacted polymerizable monomer and by-products, from the system, a portion of the aqueous medium may be distilled off by a distillation process either in the latter half of the reaction or after the completion of the reaction. The distillation process may be carried out at normal pressure or under reduced pressure.

The polymerization initiator used in the suspension polymerization method preferably has a half-life in the polymerization reaction of from 0.5 hour to 30 hours. A polymer having a maximum between molecular weights of 5000 and 50000 can be obtained when the polymerization reaction is carried out using an amount of addition of from 0.5 mass parts to 20 mass parts per 100 mass parts of the polymerizable monomer.

An oil-soluble initiator is generally used as the polymerization initiator, and examples are as follows:

azo compounds such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide-type initiators such as acetylcyclohexylsulfonyl peroxide, diisopropyl peroxycarbonate, decanoyl peroxide, lauroyl peroxide, stearoyl peroxide, propionyl peroxide, acetyl peroxide, tert-butyl peroxy-2-ethylhexanoate, benzoyl peroxide, tert-butyl peroxyisobutyrate, cyclohexanone peroxide, methyl ethyl ketone peroxide, dicumyl peroxide, tert-butyl hydroperoxide, di-tert-butyl peroxide, tert-butyl peroxypivalate, and cumene hydroperoxide.

A water-soluble initiator may be co-used as necessary for the polymerization initiator, and examples are as follows: ammonium persulfate, potassium persulfate, 2,2'-azobis(N,N'-dimethyleneisobutyroamidine) hydrochloride, 2,2'-azobis(2-aminodinopropane) hydrochloride, azobis(isobutylamidine) hydrochloride, sodium 2,2'-azobisisobutyronitrilesulfonate, ferrous sulfate, and hydrogen peroxide.

A single one of these polymerization initiators may be used or combinations of these polymerization initiators may be used, and, for example, a chain transfer agent and polymerization inhibitor may also be added and used in order to control the degree of polymerization of the polymerizable monomer.

Solid-Liquid Separation Step, Washing Step, and Drying Step

The toner particle dispersion may be treated with acid or alkali with the objective of removing the dispersion stabilizer attached on the toner particle surface.

This solid-liquid separation for recovering the toner particle from the obtained toner particle dispersion can be performed using a common filtration procedure. This is preferably followed by additional washing using reslurrying and a water wash in order to remove foreign material that could not be completely removed from the toner particle surface. After a thorough washing has been performed, another solid-liquid separation then yields a toner cake. After this, drying may be performed by known drying means and as necessary particle populations having particle diameters other than the specified particle diameter may be separated by classification to obtain a toner particle. When this is performed, the separated particle populations having out-of-specification particle diameters may be re-used in order to improve the final yield.

External Addition Step

An external additive may be added on an optional basis to the resulting toner particle. The external addition step is carried out by introducing the external additive and toner particle into a mixing apparatus equipped with an impeller that rotates at high speed and performing thorough mixing.

When the toner particle is obtained by a dissolution suspension method, a resin solution is prepared by dissolving or dispersing the following to uniformity in an organic solvent: the binder resin, resin with formula (1), and wax, and other optional materials such as colorant, charge control agent, and so forth. The resulting resin solution is granulated by dispersion in an aqueous medium, and the organic solvent present in the particles provided by granulation is removed to obtain toner particles having the desired particle diameter.

As necessary, the obtained toner particles may be subjected to a solid-liquid separation step, a washing step, a drying step, and an external addition step using the same methods as in the suspension polymerization method described above.

There are no particular limitations on the organic solvent used for the resin solution in the dissolution suspension method insofar as the organic solvent is compatible with the starting materials for the toner particle, e.g., the binder resin, resin with formula (1), wax, and so forth; however, viewed from the perspective of solvent removal, an organic solvent is preferred that exhibits a certain amount of vapor pressure even at or below the boiling point of water.

For example, toluene, xylene, ethyl acetate, butyl acetate, methyl ethyl ketone, methyl isobutyl ketone, and so forth, can be used.

To obtain the toner particle using the emulsion aggregation method, fine particles of the binder resin, fine particles of the resin with formula (1), fine particles of the wax, and optionally fine particles of other materials, e.g., colorant, charge control agent, and so forth, are first dispersed and mixed in an aqueous medium that contains a dispersion stabilizer. A surfactant may also be added to the aqueous medium. This is followed by inducing aggregation to the desired toner particle diameter by the addition of a known aggregating agent and by carrying out melt adhesion between the resin fine particles, either after aggregation or at the same time as aggregation. Shape adjustment by heating may be carried out on an optional basis.

As necessary, the obtained toner particles may be subjected to a solid-liquid separation step, a washing step, a drying step, and an external addition step using the same methods as in the suspension polymerization method. In the washing step, the impurities in the toner particles can be removed by repeated washing and filtration of the obtained particles. Specifically, preferably the toner particles are washed using an aqueous solution that contains a chelating agent, e.g., ethylenediaminetetraacetic acid (EDTA) or its Na salt, and are additionally washed a plurality of times with pure water.

The particle diameter of the toner particle is preferably a weight-average particle diameter of from 3.0 μm to 10.0 μm from the standpoint of obtaining a high-definition and high-resolution image. The weight-average particle diameter of the toner can be measured using the pore electrical resistance method. For example, measurement can be performed using a "Coulter Counter Multisizer 3" (Beckman Coulter, Inc.).

The methods used to measure the properties pertaining to the toner are described in the following.

Separation of the External Additive from the Toner

For toner having an external additive on the toner particle surface, the toner particle is obtained by separating the toner particle from the external additive using the following method.

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, comprising a nonionic surfactant, anionic surfactant, and organic builder, Wako Pure Chemical Industries, Ltd.) are introduced into a centrifugal separation tube (50 mL volume) to prepare a dispersion. 1.0 g of the toner is added to this dispersion, and clumps of the toner are broken up using, for example, a spatula.

The centrifugal separation tube is shaken with a shaker for 20 minutes at 350 strokes per minute (spm). After shaking, the solution is transferred over to a glass tube (50 mL volume) for swing rotor service, and separation is performed in a centrifugal separator (H-9R, Kokusan Co., Ltd.) using conditions of 3500 rpm and 30 minutes. The toner particle is separated from the detached external additive by this process. Satisfactory separation of the toner from the aqueous solution is checked visually, and the toner particle separated into the uppermost layer is recovered with, for example, a spatula. The recovered toner particle is filtered on a vacuum filter and then dried for at least 1 hour in a drier to yield the toner particle. This process is carried out a plurality of times to secure the required amount of toner particle.

Method for Extracting the Resin with Formula (1) from the Toner Particle

Extraction of the resin with formula (1) in the toner particle is carried out by performing separation by solvent gradient elution on an extract obtained using tetrahydrofuran (THF). The preparative method is given in the following.

10.0 g of the toner particle is weighed out and is introduced into an extraction thimble (No. 84, Toyo Roshi Kaisha, Ltd.), and this is set into a Soxhlet extractor. Extraction is performed for 20 hours using 200 mL of THF as the solvent, and the solvent is then removed from the extract to yield a solid that is the THF-soluble matter. The resin with formula (1) is contained in the THF-soluble matter. This procedure is performed a plurality of times to obtain the required quantity of THF-soluble matter.

Gradient preparative HPLC (LC-20AP High-Pressure Gradient Preparative System, Shimadzu Corporation; 50 mmØ×250 mm SunFire Preparative Column, Waters Corporation) is used for the solvent gradient elution procedure. The following are used: 30° C. for the column temperature; 50 mL/min for the flow rate; a judicious selection from THF, chloroform, and toluene for the good solvent in the mobile phase; and a judicious selection from acetonitrile, acetone, methanol, and n-hexane for the poor solvent. 0.02 g of the aforementioned THF-soluble matter dissolved in 1.5 mL of the good solvent is loaded as the sample on the gradient preparative HPLC. A composition with 100% poor solvent is used for the starting mobile phase; then, when 5 minutes have elapsed after sample introduction, the percentage of the good solvent is increased by 4% each minute; and the mobile phase composition at 25 minutes is brought to 100% good solvent. The resin with formula (1) is obtained by drying the obtained fractions to solidification. The fraction interval that is the resin with formula (1) can be determined by measurement of the silicon atom content and $^{13}$C-NMR measurement as described below. As necessary, the required amount of resin with formula (1) is obtained by repeating this solvent gradient elution.

Method for Measuring the Silicon Atom Content in the Resin with Formula (1)

An "Axios" wavelength-dispersive x-ray fluorescence analyzer (PANalytical B.V.) is used for the silicon atom content in the resin with formula (1). The "SuperQ ver. 4.0F"

(PANalytical B.V.) software provided therewith is used in order to set the measurement conditions and analyze the measurement data.

Rh is used for the x-ray tube anode, and 24 kV and 100 mA are used, respectively, for the acceleration voltage and current.

A vacuum is used for the measurement atmosphere; 27 mm is used for the measurement diameter (collimator diameter); and 10 seconds is used for the measurement time. A proportional counter (PC) is used for the detector. The measurement is carried out using PET for the analyzing crystal; the count rate (unit: cps) of Si-Kα radiation observed at a diffraction angle (2θ)=109.08° is measured; and the determination is made using a calibration curve as described in the following.

The resin with formula (1) may be used as such as the measurement sample, or the resin extracted from the toner particle using the aforementioned extraction method may be used as the measurement sample.

A "BRE-32" tablet compression molder (Maekawa Testing Machine Mfg. Co., Ltd.) is used to obtain the measurement pellet. 4 g of the measurement sample is introduced into a specialized aluminum compaction ring and is smoothed over, and a pellet is produced by molding to a thickness of 2 mm and a diameter of 39 mm by compression for 60 seconds at 20 MPa, and this pellet is used as the measurement pellet.

With regard to the pellets for construction of the calibration curve for the determination of content, $SiO_2$ (hydrophobic fumed silica) [product name: AEROSIL NAX50, specific surface area: 40±10 ($m^2/g$), carbon content: 0.45 to 0.85%, from Nippon Aerosil Co., Ltd.] is added at 0.50 mass parts per 100 mass parts of a binder [product name: Spectro Blend, components: C 81.0, O 2.9, H 13.5, N 2.6 (mass %), chemical formula: $C_{19}H_{38}ON$, form: powder (44 μm), from the Rigaku Corporation]; thorough mixing is performed in a coffee mill; and a pellet is prepared by pellet molding. The same mixing and pellet molding procedure is used to prepare pellets using the $SiO_2$ at 5.00 mass parts, 10.00 mass parts and 15.00 mass parts, respectively.

A calibration curve in the form of a linear function is obtained by placing the obtained x-ray count rate on the vertical axis and the Si addition concentration for each calibration curve sample on the horizontal axis.

The count rate for Si-Kα radiation is then also measured for the measurement sample using the same procedure. The silicon atom content (mass %) is determined from the calibration curve that has been prepared.

Structural Determination ($R^1$ to $R^3$) for the Resin Represented by Formula (1)

The structure of the $R^1$ to $R^3$ in the resin represented by formula (1) is determined by $^{29}$Si-NMR (solid state) measurement and $^{13}$C-NMR (solid state) measurement. The measurement conditions are given below. Either the resin with formula (1) as such, or the resin extracted from the toner particle by the above-described extraction method, is used as the measurement sample.

Measurement Conditions for $^{29}$Si-NMR (Solid State)

instrument: JNM-ECX500II, JEOL Resonance, Inc.
sample tube: 3.2 mmØ
sample size: 150 mg
measurement temperature: room temperature
pulse mode: CP/MAS
measurement nucleus frequency: 97.38 MHz ($^{29}$Si)
reference substance: DSS (external reference: 1.534 ppm)
sample spinning rate: 10 kHz
contact time: 10 ms
delay time: 2 s
number of scans: 2000 to 8000

This measurement makes it possible to obtain the abundance by peak separation/integration by curve fitting for the multiple silane components depending on the number of oxygen atoms bonded to the Si. Proceeding in this manner makes it possible to identify the valence with respect to the silicon atom of the alkoxy group or hydroxy group of the $R^1$ to $R^3$ in the resin given by formula (1).

Measurement Conditions for $^{13}$C-NMR (Solid State)

instrument: JNM-ECX500II, JEOL Resonance, Inc.
sample tube: 3.2 mmØ
sample size: 150 mg
measurement temperature: room temperature
pulse mode: CP/MAS
measurement nucleus frequency: 123.25 MHz ($^{13}$C)
reference substance: adamantane (external reference: 29.5 ppm)
sample spinning rate: 20 kHz
contact time: 2 ms
delay time: 2 s
number of scans: 1024

By this measurement, separation into various peaks depending on the species of $R^1$ to $R^3$ in formula (1) is performed and each is identified to determine the structure of $R^1$ to $R^3$.

Structural Determination ($P^1$ and $L^1$) of the Resin Represented by Formula (1)

The structure of the $P^1$ and $L^1$ in the resin represented by formula (1) can be determined by $^{13}$C-NMR (solid state) measurement. The measurement conditions are the same as given above under (Measurement Conditions for $^{13}$C-NMR (Solid State)). Either the resin with formula (1) as such, or the resin extracted from the toner particle by the above-described extraction method, is used as the measurement sample.

The structures of $P^1$ and $L^1$ are determined using the previous measurement by separation into individual peaks depending on the type of $P^1$ and $L^1$ in formula (1) and identification of each.

Method for Measuring the Weight-Average Molecular Weight (Mw)

The weight-average molecular weight (Mw) of the polymer, resin or toner particle is measured as follows using gel permeation chromatography (GPC).

First, the sample is dissolved in tetrahydrofuran (THF) for 24 hours at room temperature. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of 0.8 mass %. Measurement is carried out under the following conditions using this sample solution.

instrument: HLC8120 GPC (detector: RI) (Tosoh Corporation)
column: 7-column train of Shodex KF-801, 802, 803, 804, 805, 806, and 807 (Showa Denko Kabushiki Kaisha)
eluent: tetrahydrofuran (THF)
flow rate: 1.0 mL/min
oven temperature: 40.0° C.
amount of sample injection: 0.10 mL A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Method for Measuring the Saturation Compatible Amount

The saturation compatible amount at 100° C. of the ester compound with respect to 100 mass parts of the binder resin is measured as follows.

The binder resin is first extracted from the toner particle.

The binder resin is obtained by a separation procedure using the aforementioned solvent gradient elution method. Or, the type and structure of the binder resin in the toner particle are determined using known analytic procedures, e.g., $^{1}$H-NMR analysis, $^{13}$C-NMR analysis, FT-IR analysis, GC-MS analysis, GPC analysis, and so forth, and the binder resin is then separately synthesized.

The ester compound, on the other hand, is extracted from the toner particle.

Extraction of the ester compound in the toner particle is carried out by subjecting the extract obtained using THF to separation by solvent gradient elution. The required amount of THF-soluble matter is obtained using the same procedure as in the previously described Method for Extracting the Resin with Formula (1) from the Toner Particle. The ester compound is present in the THF-soluble matter.

The ester compound is obtained using the same procedure as in the previously described Method for Extracting the Resin with Formula (1) from the Toner Particle with judicious selection from THF, chloroform, and toluene for the good solvent in the mobile phase and judicious selection of acetone or methanol for the poor solvent and drying the fractions to solidification. The fraction interval that is the ester compound can be determined using known analytic procedures, e.g., $^{1}$H-NMR analysis, $^{13}$C-NMR analysis, FT-IR analysis, GC-MS analysis, GPC analysis, and so forth. The ester compound may also be obtained by identification of the type and structure of the ester compound in the toner particle using these analytic procedures and separate synthesis of the ester compound.

1.00 g of the binder resin yielded by the aforementioned procedure is measured into a 30-mL vial and this is heated to 100° C. The ester compound is then added to the vial, thorough mixing is carried out at 100° C., and visual observation is performed.

With regard to the presence/absence of compatibility, the determination is made that compatibilization has occurred when transparency is seen by the visual observation.

The ester compound is added in 0.005 g increments (0.5 mass parts with reference to 100 mass parts of the binder resin), and the maximum amount is determined at which an evaluation of compatibility without cloudiness is made.

Method for Calculating B/A

The content A of the ester compound in the toner can be determined using a step of extracting the ester compound from the toner.

The content "A" in mass % of the ester compound in the toner can be calculated from the mass of the weighed out toner and the mass of the ester compound obtained from the toner, as obtained in the aforementioned Method for Measuring the Saturation Compatible Amount.

The content B of the resin with formula (1) in the toner can be determined using a step of extracting the resin with formula (1) from the toner.

The content "B" in mass % of the resin with formula (1) in the toner can be calculated from the mass of the weighed out toner and the mass of the resin with formula (1) obtained from the toner, as obtained in the aforementioned Method for Extracting the Resin with Formula (1) from the Toner Particle.

The ratio (B/A) of B to A is then calculated using the values obtained for A and B.

Method for Calculating the Solubility Parameter (SP Value)

The solubility parameter (SP value) is determined using the Fedors equation given in formula (II) below.

For the values of Δei and Δvi, reference is made to Energies of Vaporization and Molar Volumes (25° C.) of Atoms and Atomic Groups in Tables 3-9 of "Basic Coating Science" (pp. 54-57, 1986 (Maki Shoten Publishing)).

The unit for the SP value is $(cal/cm^3)^{1/2}$, but this can be converted to the $(J/m^3)^{1/2}$ unit using $1\ (cal/cm^3)^{1/2}=2.046\times 10^3\ (J/m^3)^{1/2}$.

$$\delta i=(Ev/V)^{1/2}=(\Delta ei/\Delta vi)^{1/2} \quad \text{(II)}$$

In formula (II), Ev represents the energy of vaporization, V represents the molar volume, Δei represents the energy of vaporization of the atoms or atomic groups of component i, and Δvi represents the molar volume of the atoms or atomic groups of component i.

Method for Measuring the Melting Point

The melting point of, e.g., the ester compound and so forth, is measured based on ASTM D 3418-82 using a "Q1000" differential scanning calorimeter (TA Instruments).

The melting points of indium and zinc are used for temperature correction in the instrument detection section, and the heat of fusion of indium is used for correction of the amount of heat.

Specifically, 5 mg of the sample is exactly weighed out and this is introduced into a silver pan; an empty silver pan is used for reference. A single measurement is carried out at a ramp rate of 10° C./min from a measurement start temperature of 20° C. to a measurement end temperature of 180° C. The peak temperature of the maximum endothermic peak in the DSC curve in this first heating process is determined in the range from 20° C. to 180° C. The peak temperature of this maximum endothermic peak is taken to be the melting point (° C.).

EXAMPLES

The present invention is specifically described below using examples and comparative examples, but the present invention is not limited to or by these examples and comparative examples. Unless specifically indicated otherwise, the "parts" and "%" used for the materials in the examples and comparative examples are on a mass basis in all instances.

Styrene-Acrylic Acid Copolymer (A-1) Production Example

The styrene-acrylic acid copolymer (A-1) was produced using the following procedure.

100.0 parts of propylene glycol monomethyl ether was heated under nitrogen substitution and was heated under reflux at a liquid temperature of at least 120° C. A mixture of the following was added to this dropwise over 3 hours: 83.4 parts of styrene, 20.9 parts of butyl acrylate, and 1.0 parts of acrylic acid, as the polymerizable monomer, and 0.6 parts of tert-butyl peroxybenzoate [product name: Perbutyl Z, NOF Corporation] as the polymerization initiator. After the completion of the dropwise addition, the solution was stirred for 3 hours, and distillation at normal pressure was then carried out while raising the solution temperature to 170° C. Once the solution temperature had reached 170° C., the pressure was reduced to 1 hPa and solvent removal was performed by distillation for 1 hour to obtain a resin solid material. This resin solid material was dissolved in tetrahydrofuran and was reprecipitated with n-hexane, and the precipitated solid was filtered off to obtain a styrene-acrylic acid copolymer (A-1).

The obtained styrene-acrylic acid copolymer (A-1) had an acid value of 10.6 mg KOH/g and a weight-average molecular weight (Mw) of 13000.

Styrene-Acrylic Acid Copolymer (A-2) Production Example

The styrene-acrylic acid copolymer (A-2) was obtained using the same procedure as in the Styrene-Acrylic Acid Copolymer (A-1) Production Example, but changing the polymerizable monomer to 82.0 parts of styrene, 10.0 parts of methacrylic acid, and 8.0 parts of acrylic acid and changing the amount of the polymerization initiator to 1.0 parts.

The obtained styrene-acrylic acid copolymer (A-2) had an acid value of 161.0 mg KOH/g and a weight-average molecular weight (Mw) of 46000.

Polyester Segment (A-3) Production Example

Polyester segment (A-3) was produced using the following procedure.

The following materials were introduced into an autoclave fitted with a pressure reduction apparatus, water separation apparatus, nitrogen gas introduction apparatus, temperature measurement apparatus, and stirring apparatus and a reaction was run for 5 hours at 200° C. and normal pressure under a nitrogen atmosphere.

2.1 mol propylene oxide adduct on bisphenol A: 39.6 parts
terephthalic acid: 8.0 parts
isophthalic acid: 7.6 parts
tetrabutyl titanate: 0.1 parts This was followed by the addition of 0.01 parts of trimellitic acid and 0.12 parts of tetrabutyl titanate; reaction for 3 hours at 220° C.; and an additional reaction for 2 hours under a reduced pressure of 10 to 20 mmHg to obtain polyester resin (A-3).

The obtained polyester segment (A-3) had an acid value of 6.1 mg KOH/g and a weight-average molecular weight (Mw) of 10200.

Polyester Segments (A-4) and (A-5) Production Example

Polyester segments (A-4) and (A-5) were produced as in the Polyester Segment (A-3) Production Example, but adjusting the reaction pressure, reaction temperature, and reaction time as appropriate in order to obtain the lower molecular weight material or higher molecular weight material.

The obtained polyester segment (A-4) had an acid value of 28.0 mg KOH/g and a weight-average molecular weight (Mw) of 3100.

The obtained polyester segment (A-5) had an acid value of 1.2 mg KOH/g and a weight-average molecular weight (Mw) of 99500.

Production Example for Resin A; Resin (B-1) Given by Formula (1)

The resin (B-1) given by formula (1) was produced using the following procedure.

50.00 parts of the styrene-acrylic acid copolymer (A-1) was dissolved in 200.00 parts of N,N-dimethylacetamide; 1.20 parts of 3-aminopropyltriethoxysilane as a silane compound, 2.90 parts of triethylamine, and 2.90 parts of DMT-MM [4-(4,6-dimethoxy-1,3,5-triazin-2-yl)-4-methylmorpholinium chloride] as a condensing agent were added; and stirring was carried out for 5 hours at normal temperature. After the completion of the reaction, this solution was added dropwise to methanol to carry out reprecipitation, and the resin (B-1) with formula (1) was obtained by filtration. The obtained resin (B-1) with formula (1) had a weight-average molecular weight (Mw) of 13200.

Production Example for Resin A; Resins (B-2) to (B-8), (B-10), and (B-11) Given by Formula (1)

Resins (B-2) to (B-8), (B-10), and (B-11) given by formula (1) were obtained proceeding as in the Production Example for Resin (B-1) Given by Formula (1), but changing, as shown in Table 1, the type of $P^1$ (macromolecular segment), the type and amount of addition of the silane compound, and the amounts of addition of the triethylamine and DMT-MM.

Production Example for Resin A; Resin (B-9) Given by Formula (1)

400.0 parts pure water was mixed by stirring with a solution of 10.0 parts of the resin (B-8) with formula (1) dissolved in 90.0 parts of toluene; the pH was adjusted to 4.0 using dilute hydrochloric acid; stirring was carried out for 10.8 hours at normal temperature; stirring was then halted and transfer to a separatory funnel was performed; and the oil phase was extracted. This oil phase was condensed and reprecipitated with methanol to obtain a resin (B-9) given by formula (1).

All of the $R^1$ to $R^3$ in formula (1) were the hydroxy group according to analysis by measurement of the obtained resin (B-9) with formula (1) using $^{29}$Si-NMR (solid state).

Production Example for Resin A; Resin (B-12) Given by Formula (1)

The resin (B-12) given by formula (1) was produced using the following procedure.

50.00 parts of the polyester segment (A-3) was dissolved in 500.00 parts of chloroform; 0.74 parts of 3-isocyanatopropyltriethoxysilane and 0.50 parts of titanium(IV) tetraisopropoxide were added under a nitrogen atmosphere; and stirring was carried out for 5 hours at normal temperature. After the completion of the reaction, reprecipitation was carried out by adding the solution dropwise to methanol, and the resin (B-12) with formula (1) was obtained by filtration.

The structure and properties of the obtained resins A; resins (B-1) to (B-12) with formula (1) are given in Table 2.

TABLE 1

| resin represented by formula (1) (resin A) type | macromolecular segment $P^1$ type | Mw | acid value [mg KOH/g] | silane compound type | amount of addition [parts] | triethylamine amount of addition [parts] | condensing agent (DMT - MM) amount of addition [parts] |
|---|---|---|---|---|---|---|---|
| B-1 | A-1 | 13000 | 10.6 | 3-aminopropyltriethoxysilane | 1.20 | 2.90 | 2.90 |
| B-2 | A-2 | 46000 | 161.0 | 3-aminopropylsilicone | 10.00 | 43.60 | 43.70 |
| B-3 | A-3 | 10200 | 6.1 | 3-aminopropyltriethoxysilane | 1.20 | 1.70 | 1.70 |
| B-4 | A-4 | 3100 | 28.0 | | 4.00 | 7.60 | 7.60 |
| B-5 | A-5 | 99500 | 1.2 | | 0.12 | 0.40 | 0.35 |
| B-6 | A-3 | 10200 | 6.1 | | 0.05 | 1.70 | 1.70 |
| B-7 | | | | | 0.10 | 1.70 | 1.70 |
| B-8 | | | | 3-aminopropyltrimethoxysilane | 0.97 | 1.70 | 1.70 |
| B-9 | | | | | 0.97 | 1.70 | 1.70 |
| B-10 | | | | 3-aminopropyldimethylethoxysilane | 0.88 | 1.70 | 1.70 |
| B-11 | | | | 3-aminopropyltrimethylsilane | 0.72 | 1.70 | 1.70 |
| B-12 | | | | 3-isocyanatopropyltriethoxysilane | 0.74 | — | — |

TABLE 2

| resin represented by formula (1) (resin A) No. | $P^1$ | $R^1$ | $R^2$ | $R^3$ | $L^1$ | $R^5$ | $R^6$ | Mw | silicon atom content [mass %] |
|---|---|---|---|---|---|---|---|---|---|
| B-1 | A-1 | $—OC_2H_5$ | $—OC_2H_5$ | $—OC_2H_5$ | formula (2) | $—C_3H_6—$ | — | 13200 | 0.29 |
| B-2 | A-2 | —H | —H | —H | formula (2) | $—C_3H_6—$ | — | 46000 | 5.38 |
| B-3 | A-3 | $—OC_2H_5$ | $—OC_2H_5$ | $—OC_2H_5$ | formula (2) | $—C_3H_6—$ | — | 11300 | 0.22 |
| B-4 | A-4 | $—OC_2H_5$ | $—OC_2H_5$ | $—OC_2H_5$ | formula (2) | $—C_3H_6—$ | — | 3300 | 0.92 |
| B-5 | A-5 | $—OC_2H_5$ | $—OC_2H_5$ | $—OC_2H_5$ | formula (2) | $—C_3H_6—$ | — | 99700 | 0.02 |
| B-6 | A-3 | $—OC_2H_5$ | $—OC_2H_5$ | $—OC_2H_5$ | formula (2) | $—C_3H_6—$ | — | 10200 | 0.01 |
| B-7 | A-3 | $—OC_2H_5$ | $—OC_2H_5$ | $—OC_2H_5$ | formula (2) | $—C_3H_6—$ | — | 10200 | 0.02 |
| B-8 | A-3 | $—OCH_3$ | $—OCH_3$ | $—OCH_3$ | formula (2) | $—C_3H_6—$ | — | 10400 | 0.28 |
| B-9 | A-3 | —OH | —OH | —OH | formula (2) | $—C_3H_6—$ | — | 10400 | 0.29 |
| B-10 | A-3 | $—OC_2H_5$ | $—CH_3$ | $—CH_3$ | formula (2) | $—C_3H_6—$ | — | 10400 | 0.29 |
| B-11 | A-3 | $—CH_3$ | $—CH_3$ | $—CH_3$ | formula (2) | $—C_3H_6—$ | — | 10300 | 0.30 |
| B-12 | A-3 | $—OC_2H_5$ | $—OC_2H_5$ | $—OC_2H_5$ | formula (3) | — | $—C_3H_6-$ | 10300 | 0.16 |

Toner Particle 1 Production Example 390.0 parts of deionized water and 14.0 parts of sodium phosphate (dodecahydrate) (RASA Industries, Ltd.) were introduced into a reactor and the temperature was held at 65° C. for 1.0 hour while purging with nitrogen. An aqueous calcium chloride solution of 9.2 parts of calcium chloride (dihydrate) dissolved in 10.0 parts of deionized water was introduced all at once while stirring at 12000 rpm using a T. K. Homomixer (Tokushu Kika Kogyo Co., Ltd.) to prepare an aqueous medium containing a dispersion stabilizer. Hydrochloric acid was introduced into the aqueous medium to adjust the pH to 6.0, thus yielding aqueous medium 1.

The following materials, on the other hand, were introduced into an attritor (Nippon Coke & Engineering Co., Ltd.) and dispersion was carried out for 5.0 hours at 220 rpm using zirconia particles with a diameter of 1.7 mm; this was followed by the removal of the zirconia particles to provide a dispersion 1 in which the colorant was dispersed.

| | |
|---|---|
| styrene | 60.0 parts |
| colorant (C.I. Pigment Blue 15:3) | 6.5 parts |

The following materials were then added to the thusly prepared dispersion 1.

| | |
|---|---|
| styrene | 15.0 parts |
| n-butyl acrylate | 25.0 parts |
| styrene-acrylic acid copolymer (A-1) | 4.0 parts |
| resin A (B-1) | 8.0 parts |
| divinylbenzene | 0.6 parts |
| ester compound (ethylene glycol distearate) | 12.0 parts |
| wax (Fischer-Tropsch wax, melting point = 78° C.) | 3.0 parts |

This was then held at 65° C. and a polymerizable monomer composition 1 was prepared by dissolving and dispersing to uniformity at 500 rpm using a T. K. Homomixer.

While holding the temperature of aqueous medium 1 at 70° C. and the stirrer rotation rate at 12000 rpm, the polymerizable monomer composition 1 was introduced into the aqueous medium 1 and 9.0 parts of the polymerization initiator t-butyl peroxypivalate was added. Granulation was performed in this state for 10 minutes while maintaining 12000 rpm with the stirrer.

The aforementioned stirrer was replaced with a stirrer equipped with a propeller impeller and polymerization was carried out for 5.0 hours while maintaining 70° C. and stirring at 150 rpm. The temperature was raised to 85° C. and holding with heating was carried out for 2.0 hours; this was followed by cooling to room temperature at a rate of 0.83° C./sec to obtain an aqueous dispersion. This aqueous dispersion was subsequently heated to 55° C.; holding was carried out for 5.0 hours; and cooling to room temperature was then carried out to obtain a toner particle dispersion 1.

Hydrochloric acid was added to the resulting toner particle dispersion 1 to bring the pH to 1.4 or below and dissolve the dispersion stabilizer; filtration, washing, and drying were then carried out to obtain a toner particle 1.

Toner Particle 2 Production Example

The following materials were introduced under a nitrogen atmosphere into a reactor fitted with a reflux condenser, stirrer, and nitrogen introduction line.

| | |
|---|---|
| toluene | 100.0 parts |
| styrene | 75.0 parts |
| n-butyl acrylate | 25.0 parts |
| divinylbenzene | 0.6 parts |
| t-butyl peroxypivalate | 3.0 parts |

While stirring the interior of the reactor at 200 rotations per minute and heating at 70° C., holding was carried out for 10 hours to yield resin solution 2.

The following components:

| | |
|---|---|
| resin solution 2 | 203.6 parts |
| polyester segment (A-3) | 4.0 parts |
| resin A (B-1) | 8.0 parts |
| ester compound (ethylene glycol distearate) | 12.0 parts |
| wax (Fischer-Tropsch wax, melting point = 78° C.) | 3.0 parts |
| colorant (C.I. Pigment Blue 15:3) | 6.5 parts |

were dispersed for 10.0 hours at 220 rpm using zirconia particles with a diameter of 1.7 mm, after which the zirconia particles were removed to obtain a resin composition solution 2.

This resin composition solution 2 was introduced into aqueous medium 1, which was obtained using the same procedure as in the production of toner particle 1, and a granulation step was run for 10 minutes using a ClearMix while maintaining 15000 rpm to obtain a resin composition dispersion 2.

The toluene in the resin composition dispersion 2 was removed by raising the temperature of the resin composition dispersion 2 to 95° C. and stirring for 120 minutes. This was followed by cooling to room temperature at a rate of 0.83° C./sec, then heating to 55° C. and holding for 5.0 hours, and then cooling to room temperature to yield toner particle dispersion 2.

Hydrochloric acid was added to the resulting toner particle dispersion 2 to bring the pH to 1.4 or below and dissolve the dispersion stabilizer; filtration, washing, and drying were then carried out to obtain a toner particle 2.

Toner Particle 3 Production Example

The following materials were introduced into a reactor and dissolved.

| | |
|---|---|
| styrene | 75.0 parts |
| n-butyl acrylate | 25.0 parts |
| styrene-acrylic acid copolymer (A-1) | 4.0 parts |
| resin A (B-1) | 8.0 parts |
| divinylbenzene | 0.6 parts |
| n-lauryl mercaptan | 3.2 parts |

An aqueous solution of 1.5 parts of Neogen RK (DKS Co. Ltd.) and 150.0 parts of deionized water was then added and dispersion was carried out. An aqueous solution of 0.3 parts of potassium persulfate and 10.0 parts of deionized water was also added while gently stirring. After the reactor had been substituted with nitrogen, an emulsion polymerization was run for 6 hours at 70° C. After the completion of polymerization, the reaction solution was cooled to room temperature and a resin particle dispersion having a solids fraction concentration of 12.5 mass % and a weight-average particle diameter of 0.2 μm was obtained by the addition of deionized water.

In addition, 80.0 parts of ethylene glycol distearate, 20.0 parts of a Fischer-Tropsch wax (melting point: 78° C.), and 15.0 parts of Neogen RK were mixed into 385.0 parts of deionized water, and dispersion was performed for 1 hour using a JN100 wet jet mill (JOKOH Co., Ltd.). Deionized water was added to the resulting dispersion to obtain a wax dispersion having a solids fraction concentration of 20.0 mass %.

100.0 parts of C. I. Pigment Blue 15:3 as colorant and 15.0 parts of Neogen RK were mixed into 885.0 parts of deionized water, and dispersion was performed for 1 hour using a JN100 wet jet mill. Deionized water was added to the resulting dispersion to obtain a colorant dispersion having a solids fraction concentration of 10.0 mass %.

80.0 parts of the resin particle dispersion, 9.0 parts of the wax dispersion, and 6.0 parts of the colorant dispersion, as obtained in accordance with the above-described procedures, were introduced into a reactor, and stirring was carried out using a homogenizer (Ultra-Turrax T50, IKA). Then, while continuing this stirring process, the temperature in the reactor was adjusted to 30° C. and the pH was adjusted to 8.0 by the addition of a 1 mol/L aqueous solution of sodium hydroxide. An aqueous solution of 0.3 parts of magnesium sulfate dissolved in 10.0 parts of deionized water was then added as an aggregating agent over 10 minutes while stirring at 30° C.

After 3 hours had elapsed, heating was begun and the production of aggregated particles was carried out by raising the temperature to 50° C. The particle diameter of the aggregated particles was measured using a "Coulter Counter Multisizer 3" (registered trademark, Beckman Coulter, Inc.).

Once the weight-average particle diameter of the aggregated particles had reached 6.0 μm, 0.9 parts of sodium chloride and 5.0 parts of Neogen RK were added to the reactor and the particle growth of the aggregated particles was stopped.

The temperature of the reactor was then raised to 62° C. and holding was carried out for 8 hours; the temperature of the reactor was subsequently raised to 85° C. and holding was carried out for 1 hour; and cooling to room temperature at 0.83° C./sec was then performed. The temperature of the reactor was then raised to 55° C. and holding was carried out for 5.0 hours; this was followed by cooling to room temperature to obtain a toner particle dispersion 3.

Filtration and washing were performed on the resulting toner particle dispersion 3 several times, and drying then yielded a toner particle 3.

Toner Particles 4 to 9, 11, 13 to 16, 19 to 23, and 25 to 34 Production Example

Toner Particles 4 to 9, 11, 13 to 16, 19 to 23, and 25 to 34 were obtained proceeding as in the Toner Particle 1 Production Example, but changing each of the following as described in Table 3: the type and amount of addition of resin A, the type and amount of addition of the ester compound, and the type and amount of addition of the wax.

Toner Particle 10 Production Example

The following materials were introduced into a reactor; dispersion was then carried out for 10.0 hours at 220 rpm using zirconia particles with a diameter of 1.7 mm; and the zirconia particles were subsequently removed to obtain a resin composition solution 10.

| | |
|---|---|
| toluene | 100.0 parts |
| polyester segment (A-3) | 100.0 parts |
| resin A (B-3) | 8.0 parts |
| ester compound (ethylene glycol distearate) | 12.0 parts |
| colorant (C.I. Pigment Blue 15:3) | 6.5 parts |

This resin composition solution 10 was introduced into aqueous medium 1, which was obtained using the same procedure as in the Toner Particle 1 Production Example, and a granulation step was run for 10 minutes while maintaining 15000 rpm with a ClearMix to obtain a resin composition dispersion 10.

The toluene in the resin composition dispersion 10 was removed by raising the temperature of the resin composition dispersion 10 to 95° C. and stirring for 120 minutes. This was followed by cooling to room temperature at a rate of 0.83° C./sec, then heating to 55° C. and holding for 5.0 hours, and then cooling to room temperature to yield toner particle dispersion 10.

Hydrochloric acid was added to the resulting toner particle dispersion 10 to bring the pH to 1.4 or below and dissolve the dispersion stabilizer; filtration, washing, and drying were then carried out to obtain a toner particle 10.

Toner Particle 12 Production Example

Toner particle 12 was obtained using the same procedure as in the Toner Particle 2 Production Example, but without the addition of the Fischer-Tropsch wax and changing the resin solution 2 to 101.8 parts, the polyester segment (A-3) to 50.0 parts, and the ester compound to dibehenyl adipate.

Toner Particle 17 Production Example

Toner particle 17 was obtained using the same procedure as in the Toner Particle 2 Production Example, but without the addition of the Fischer-Tropsch wax and changing the polyester segment (A-3) to the styrene-acrylic acid copolymer (A-1), the 8.0 parts of resin A (B-1) to 20.0 parts of resin A (B-3), and the ethylene glycol distearate to dibehenyl adipate.

Toner Particle 18 Production Example

Toner particle 18 was obtained using the same procedure as in the Toner Particle 17 Production Example, but changing the resin A (B-3) to 55.0 parts and changing the dibehenyl adipate to 5.0 parts.

Toner Particle 24 Production Example

Toner particle 24 was obtained using the same procedure as in the Toner Particle 17 Production Example, but changing the resin A (B-3) to 20.0 parts and changing the dibehenyl adipate to 30.0 parts.

Toner Particle 35 Production Example

Toner particle 35 was obtained proceeding as in the Toner Particle 1 Production Example, but changing the 8.0 parts of resin A (B-1) to 3.7 parts of trimethoxyvinylsilane.

Toner particle 35 had a saturation compatible amount of 44.5 mass parts and an $[(SP_C-SP_W)^2\times Mw]$ of 537.

TABLE 3

| toner particle | resin A | | ester compound | | | | | wax | | |
|---|---|---|---|---|---|---|---|---|---|---|
| | | | | melting point | | | $(SP_C-SP_W)^2\times$ | | melting point | |
| No. | No. | parts | type | [° C.] | Y | parts | Mw | type | [° C.] | parts |
| 1 | B-1 | 8.0 | ethylene glycol distearate | 76 | 45.0 | 12.0 | 537 | F.T. | 78 | 3.0 |
| 4 | B-1 | 8.0 | ethylene glycol dimyristate | 63 | 100.0 | 12.0 | 391 | F.T. | 78 | 3.0 |
| 5 | B-1 | 8.0 | ethylene glycol dibehenate | 83 | 14.0 | 12.0 | 693 | F.T. | 78 | 3.0 |
| 6 | B-1 | 8.0 | hexanediol distearate | 63 | 25.0 | 12.0 | 613 | F.T. | 78 | 3.0 |
| 7 | B-1 | 8.0 | octanediol distearate | 57 | 15.0 | 12.0 | 652 | F.T. | 78 | 3.0 |
| 8 | B-1 | 8.0 | dibehenyl adipate | 72 | 9.0 | 12.0 | 778 | F.T. | 78 | 3.0 |
| 9 | B-1 | 8.0 | dibehenyl adipate | 72 | 9.0 | 12.0 | 778 | — | — | — |
| 10 | B-3 | 8.0 | ethylene glycol distearate | 76 | 6.5 | 12.0 | 850 | — | — | — |
| 11 | B-3 | 8.0 | dibehenyl adipate | 72 | 9.0 | 12.0 | 778 | — | — | — |
| 12 | B-1 | 8.0 | dibehenyl adipate | 72 | 7.8 | 12.0 | 814 | — | — | — |
| 13 | B-4 | 8.0 | dibehenyl adipate | 72 | 9.0 | 12.0 | 778 | — | — | — |
| 14 | B-5 | 8.0 | dibehenyl adipate | 72 | 9.0 | 12.0 | 778 | — | — | — |
| 15 | B-3 | 1.0 | dibehenyl adipate | 72 | 9.0 | 12.0 | 778 | — | — | — |
| 16 | B-3 | 1.2 | dibehenyl adipate | 72 | 9.0 | 12.0 | 778 | — | — | — |
| 17 | B-3 | 20.0 | dibehenyl adipate | 72 | 9.0 | 12.0 | 778 | — | — | — |
| 18 | B-3 | 55.0 | dibehenyl adipate | 72 | 9.0 | 5.0 | 778 | — | — | — |
| 19 | B-6 | 8.0 | dibehenyl adipate | 72 | 9.0 | 12.0 | 778 | — | — | — |
| 20 | B-7 | 8.0 | dibehenyl adipate | 72 | 9.0 | 12.0 | 778 | — | — | — |
| 21 | B-2 | 8.0 | dibehenyl adipate | 72 | 9.0 | 12.0 | 778 | — | — | — |
| 22 | B-3 | 8.0 | dibehenyl adipate | 72 | 9.0 | 3.0 | 778 | — | — | — |
| 23 | B-3 | 8.0 | dibehenyl adipate | 72 | 9.0 | 5.0 | 778 | — | — | — |
| 24 | B-3 | 20.0 | dibehenyl adipate | 72 | 9.0 | 30.0 | 778 | — | — | — |

TABLE 3-continued

| toner particle | resin A | | ester compound | | | | | | wax | | |
|---|---|---|---|---|---|---|---|---|---|---|---|
| | | | | melting point | | | $(SP_C - SP_W)^2 \times$ | | | melting point | |
| No. | No. | parts | type | [° C.] | Y | parts | Mw | | type | [° C.] | parts |
| 25 | B-8 | 8.0 | dibehenyl adipate | 72 | 9.0 | 12.0 | 778 | | — | — | — |
| 26 | B-9 | 8.0 | dibehenyl adipate | 72 | 9.0 | 12.0 | 778 | | — | — | — |
| 27 | B-10 | 8.0 | dibehenyl adipate | 72 | 9.0 | 12.0 | 778 | | — | — | — |
| 28 | B-11 | 8.0 | dibehenyl adipate | 72 | 9.0 | 12.0 | 778 | | — | — | — |
| 29 | B-12 | 8.0 | dibehenyl adipate | 72 | 9.0 | 12.0 | 778 | | — | — | — |
| 30 | B-12 | 8.0 | dibehenyl terephthalate | 89 | 6.0 | 12.0 | 440 | | — | — | — |
| 31 | B-12 | 8.0 | behenyl behenate | 73 | 5.0 | 12.0 | 950 | | — | — | — |
| 32 | — | — | ethylene glycol distearate | 76 | 45.0 | 12.0 | 537 | | F.T. | 78 | 3.0 |
| 33 | B-1 | 8.0 | glycerol tribehenate | 68 | 3.0 | 12.0 | 976 | | F.T. | 78 | 3.0 |
| 34 | B-1 | 8.0 | ethylene glycol dimontanate | 95 | 3.5 | 12.0 | 961 | | F.T. | 78 | 3.0 |

In the table, Y represents the saturation compatible amount [mass parts] and F. T. represents Fischer-Tropsch wax.

Toners 1 to 31 and Comparative Toners 32 to 35 Production Example 0.6 parts of hydrophobic silica fine particles having a BET value of 200 $m^2/g$ and a number-average primary particle diameter of 8 nm was mixed, using a Henschel mixer (Mitsui Miike Chemical Engineering Machinery Co., Ltd.), with each of 100.0 parts of the obtained toner particles 1 to 31 and toner particles 32 to 35.

This mixing process was followed by screening across a mesh with an aperture of 150 μm to yield toners 1 to 31 and comparative toners 32 to 35.

Examples 1 to 31 and Comparative Examples 1 to 4

The resulting toners 1 to 31 and comparative toners 32 to 35 were each subjected to property evaluations in accordance with the following methods. The results of the evaluations are given in Table 4.

Evaluation of the Low-Temperature Fixability

A color laser printer (HP Color LaserJet 3525dn, Hewlett-Packard) was prepared as the image-forming apparatus by detaching the fixing unit, and the toner was removed from the cyan cartridge and the toner to be evaluated was loaded in its place. Using the loaded toner, an unfixed toner image (toner laid-on level: 0.9 $mg/cm^2$) 2.0 cm long and 15.0 cm wide was then formed on the image-receiving paper (HP Laser Jet 90, Hewlett-Packard, 90 $g/m^2$) at the region 1.0 cm from the leading edge with respect to the paper feed direction. The detached fixing unit was then modified to enable the fixation temperature and process speed to be adjustable, and this was used to carry out a fixing test on the unfixed image.

First, with the process speed set to 350 mm/s and operating in a normal-temperature, normal-humidity environment (temperature of 23° C. and relative humidity of 60%), the unfixed image was fixed at each temperature, starting from an initial temperature of 140° C. and increasing the set temperature sequentially in 5° C. increments.

The criteria for evaluating the low-temperature fixability are given below. The low temperature-side fixing onset point is the lower temperature limit at which cold offset behavior (behavior whereby a portion of the toner ends up attached to the fixing unit) is not observed.

Evaluation Criteria

A: the low temperature-side fixing onset point is equal to or less than 165° C.

B: the low temperature-side fixing onset point is at least 170° C., but not more than 180° C.

C: the low temperature-side fixing onset point is at least 185° C., but not more than 195° C.

D: the low temperature-side fixing onset point is at least 200° C., but not more than 210° C.

E: the low temperature-side fixing onset point is equal to or greater than 215° C.

Evaluation of the Gloss Reduction for the Fixed Image

The gloss reduction was evaluated using fixed images obtained in accordance with the Evaluation of the Low-Temperature Fixability as described above.

The obtained fixed image was held for 10 minutes in a normal-temperature, normal-humidity environment (temperature of 23° C., relative humidity of 60%), and the gloss value was then measured using a PG-1 Handy Gloss Meter (Nippon Denshoku Industries Co., Ltd.). With regard to the measurement conditions, 75° was used for both the light projection angle and the light receiving angle; the measurement was performed at 5 different points on the fixed image; and the average value thereof was used as the initial gloss value post-fixing.

The fixed image for which the gloss value had been measured was then held for 10 days in an environment having a temperature of 40° C. and a relative humidity of 95%, after which it was held for 1 day in a normal-temperature, normal-humidity environment (temperature of 23° C., relative humidity of 60%).

The gloss value was measured at the same locations at which the initial gloss value post-fixing was measured, and the average value of the 5 points was taken to be the gloss value post-ageing.

The percentage change in the gloss value post-ageing versus the initial gloss value post-fixing was calculated from these results.

Evaluation Criteria

A: the percentage change in the gloss value is less than 5.0%
B: the percentage change in the gloss value is at least 5.0%, but less than 10.0%
C: the percentage change in the gloss value is at least 10.0%, but less than 15.0%
D: the percentage change in the gloss value is at least 15.0%, but less than 20.0%
E: the percentage change in the gloss value is at least 20.0%

Evaluation of Development Streaks During Durability Testing

When a toner undergoes cracking when subjected to loading in the developing apparatus, this facilitates the generation of development streaks as an image defect. The degree of development streak generation was evaluated using the following method.

GF-500 (A4, areal weight=64.0 g/m$^2$, sold by Canon Marketing Japan Inc.) was used as the evaluation paper, and 20000 prints of a chart with a 2% print percentage were continuously output in a normal-temperature, normal-humidity environment (temperature of 23° C., relative humidity of 60%). This was followed by the output of a halftone image (toner laid-on level: 0.6 mg/cm$^2$), and the state of image streaking in the halftone image was evaluated.

Evaluation Criteria

A: development streaks are not produced
B: development streaks are produced at one or two locations
C: development streaks are produced at three or four locations
D: development streaks are produced at five or six locations
E: development streaks are produced at seven or more locations, or a development streak with a width of 0.5 mm or more is produced Evaluation of the Resistance to Wraparound During Fixing Wraparound of the fixing roller by the fixed image is suppressed when the fixed image exhibits a satisfactory releasability. The resistance to wraparound during fixing was evaluated as follows.

The machine used for the evaluation was the same machine as used for the aforementioned evaluation of the low-temperature fixability. With the toner laid-on level on the paper adjusted to 1.2 mg/cm$^2$, 10 prints were made of an unfixed image with a width of 60 mm in the paper feed direction at a location 1 mm from the end.

GF-500 (A4, areal weight=64.0 g/m$^2$, sold by Canon Marketing Japan Inc.) was used as the evaluation paper.

Then, while operating in a high-temperature, high-humidity environment (temperature of 30° C., relative humidity of 80%), the ten prints were continuously fed at a paper transport speed of 200 mm/sec while raising the fixation temperature in 5° C. steps in sequence from 150° C., and the upper limit temperature at which wraparound during fixing was not produced was taken to be the fixing wraparound-resistance temperature.

Evaluation Criteria

A: wraparound is not produced even at 200° C.
B: the fixing wraparound-resistance temperature is at least 190° C., but less than 200° C.
C: the fixing wraparound-resistance temperature is at least 180° C., but less than 190° C.
D: the fixing wraparound-resistance temperature is at least 170° C., but less than 180° C.
E: wraparound is produced at 165° C.

The results of the evaluations of the toner properties are given in Table 4.

TABLE 4

| | toner particle No. | toner No. | low-temperature fixability (° C.) | | percentage change in gloss value | | development streaking evaluation | fixing wraparound-resistance temperature | |
|---|---|---|---|---|---|---|---|---|---|
| Example 1 | 1 | 1 | 155 | A | 3.3% | A | A | at least 200° C. | A |
| Example 2 | 2 | 2 | 155 | A | 3.6% | A | A | at least 200° C. | A |
| Example 3 | 3 | 3 | 155 | A | 4.0% | A | A | at least 200° C. | A |
| Example 4 | 4 | 4 | 155 | A | 5.8% | B | A | 180° C. | C |
| Example 5 | 5 | 5 | 165 | A | 3.2% | A | A | at least 200° C. | A |
| Example 6 | 6 | 6 | 160 | A | 4.1% | A | A | at least 200° C. | A |
| Example 7 | 7 | 7 | 165 | A | 3.8% | A | A | 185° C. | C |
| Example 8 | 8 | 8 | 170 | B | 4.2% | A | A | at least 200° C. | A |
| Example 9 | 9 | 9 | 175 | B | 6.8% | B | A | 195° C. | B |
| Example 10 | 10 | 10 | 185 | C | 3.5% | A | A | 190° C. | B |
| Example 11 | 11 | 11 | 175 | B | 11.2% | C | B | 195° C. | B |
| Example 12 | 12 | 12 | 190 | C | 8.1% | B | B | 195° C. | B |
| Example 13 | 13 | 13 | 175 | B | 13.3% | C | B | 195° C. | B |
| Example 14 | 14 | 14 | 180 | B | 14.0% | C | C | 195° C. | B |
| Example 15 | 15 | 15 | 170 | B | 11.1% | C | C | 195° C. | B |
| Example 16 | 16 | 16 | 170 | B | 9.3% | B | C | 195° C. | B |
| Example 17 | 17 | 17 | 180 | B | 4.4% | A | A | 195° C. | B |
| Example 18 | 18 | 18 | 195 | C | 2.6% | A | A | 195° C. | B |
| Example 19 | 19 | 19 | 175 | B | 14.5% | C | C | at least 200° C. | A |
| Example 20 | 20 | 20 | 175 | B | 13.3% | C | C | at least 200° C. | A |
| Example 21 | 21 | 21 | 175 | B | 14.0% | C | C | 195° C. | B |
| Example 22 | 22 | 22 | 195 | C | 2.0% | A | A | at least 200° C. | A |
| Example 23 | 23 | 23 | 185 | C | 2.8% | A | A | at least 200° C. | A |
| Example 24 | 24 | 24 | 160 | A | 7.7% | B | C | 185° C. | C |
| Example 25 | 25 | 25 | 175 | B | 4.4% | A | A | 195° C. | B |
| Example 26 | 26 | 26 | 175 | B | 4.8% | A | A | 195° C. | B |
| Example 27 | 27 | 27 | 175 | B | 8.8% | B | B | 195° C. | B |
| Example 28 | 28 | 28 | 175 | B | 10.4% | C | C | 195° C. | B |

TABLE 4-continued

| | toner particle No. | toner No. | low-temperature fixability (° C.) | | percentage change in gloss value | | development streaking evaluation | fixing wraparound-resistance temperature | |
|---|---|---|---|---|---|---|---|---|---|
| Example 29 | 29 | 29 | 175 | B | 11.2% | C | C | 195° C. | B |
| Example 30 | 30 | 30 | 190 | C | 10.0% | C | C | 195° C. | B |
| Example 31 | 31 | 31 | 195 | C | 9.6% | B | C | 195° C. | B |
| Comparative Example 1 | 32 | Comparative 32 | 155 | A | 28.1% | E | E | at least 200° C. | A |
| Comparative Example 2 | 33 | Comparative 33 | 210 | D | 2.6% | A | A | at least 200° C. | A |
| Comparative Example 3 | 34 | Comparative 34 | 215 | E | 2.2% | A | A | at least 200° C. | A |
| Comparative Example 4 | 35 | Comparative 35 | 170 | B | 17.7% | D | D | at least 200° C. | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-083936, filed Apr. 25, 2019, which is hereby incorporated by reference herein in its entirety.

What is claimed is:

1. A toner, comprising:

a toner particle that contains a binder resin, a resin represented by formula (1), and wax (1)

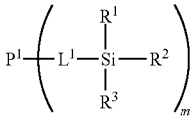

where $P^1$ represents a macromolecular segment; $L^1$ represents formulae (2) or (3)

(2)

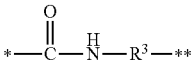

(3)

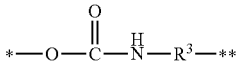

where $R^1$ to $R^3$ independently represent a hydrogen atom, halogen atom, alkyl group, alkoxy group, hydroxy group or aryl group; m represents a positive integer; * represents a bonding segment to $P^1$, ** represents a bonding segment to Si, $R^5$ represents a single bond, an alkylene group or an arylene group, and $R^6$ represents a single bond, an alkylene group or an arylene group, with the proviso that when m is equal to or greater than 2, a plurality of $L^1$'s may be the same or different from each other, a plurality of $R^1$'s may be the same or different from each other, a plurality of $R^2$'s may be the same or different from each other, and a plurality of $R^3$'s may be the same or different from each other, wherein the wax contains an ester compound that exhibits a compatibility at 100° C. of at least 5.0 mass parts per 100.0 mass parts of the binder resin.

2. The toner according to claim 1, wherein at least one of $R^1$ to $R^3$ represents an alkoxy group or hydroxy group.

3. The toner according to claim 1, wherein a content of the ester compound is 5.0 to 30.0 mass parts per 100 mass parts of the binder resin.

4. The toner according to claim 1, wherein a silicon atom content in the resin represented by formula (1) is 0.02 to 10.00 mass %.

5. The toner according to claim 1, wherein a ratio of B to A is from 0.10 to 10.00 where A is a mass % content of the ester compound in the toner and B is a mass % content of the resin represented by formula (1) in the toner.

6. The toner according to claim 1, wherein the resin represented by formula (1) has a weight-average molecular weight of 3000 to 100000.

7. The toner according to claim 1, wherein the binder resin contains a styrene-acrylic acid copolymer, and the macromolecular segment contains a styrene-acrylic acid copolymer.

8. The toner according to claim 1, wherein the binder resin contains a polyester segment, and the macromolecular segment contains a polyester segment.

9. The toner according to claim 1, wherein the toner particle further contains a hydrocarbon wax.

10. The toner according to claim 1, wherein the ester compound is a condensate of a diol having 2 to 10 carbons and an aliphatic monocarboxylic acid having 14 to 22 carbons, and has a melting point of 60 to 100° C.

11. The toner according to claim 1, wherein the resin represented by formula (1) is 6.0 to 50.0 mass % of the total resin in the toner particle.

12. The toner according to claim 1, wherein the binder resin is at least 50.0 mass % of the total resin in the toner particle.

13. The toner according to claim 1, wherein the resin represented by formula (1) has a weight-average molecular weight of 5000 to 30000.

14. A toner, comprising:

a toner particle that contains a binder resin, a resin represented by formula (1), and wax (1)

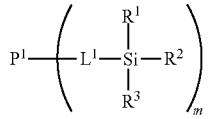

where $P^1$ represents a macromolecular segment; $L^1$ represents formulae (2) or (3)

(2)

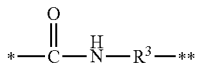

-continued (3)

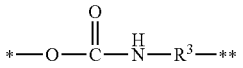

where $R^1$ to $R^3$ independently represent a hydrogen atom, halogen atom, alkyl group, alkoxy group, hydroxy group or aryl group; m represents a positive integer; * represents a bonding segment to $P^1$, ** represents a bonding segment to Si, $R^5$ represents a single bond, an alkylene group or an arylene group, and $R^6$ represents a single bond, an alkylene group or an arylene group, with the proviso that when m is equal to or greater than 2, a plurality of $L^1$'s may be the same or different from each other, a plurality of $R^1$'s may be the same or different from each other, a plurality of $R^2$'s may be the same or different from each other, and a plurality of $R^3$'s may be the same or different from each other, wherein the wax contains an ester compound that is a condensate of a diol having 2 to 10 carbons and an aliphatic monocarboxylic acid having 14 to 22 carbons, and has a melting point of 60 to 100° C.

* * * * *